US012303772B1

(12) United States Patent
Curley

(10) Patent No.: US 12,303,772 B1
(45) **Date of Patent: *May 20, 2025**

(54) COMPACT CONTINUOUS SHUFFLER

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/956,048

(22) Filed: Nov. 22, 2024

Related U.S. Application Data

(63) Continuation-in-part of application No. 18/737,984, filed on Jun. 8, 2024, now Pat. No. 12,179,090.

(51) Int. Cl.
*A63F 1/12* (2006.01)
*A63F 1/14* (2006.01)

(52) U.S. Cl.
CPC . *A63F 1/12* (2013.01); *A63F 1/14* (2013.01)

(58) Field of Classification Search
CPC ..... A63F 1/12; A63F 1/14
See application file for complete search history.

(56) References Cited

U.S. PATENT DOCUMENTS 1,885,276 A 11/1932 Mckay
3,260,520 A 7/1966 Sugden
3,771,783 A 11/1973 McInerny
4,457,512 A 7/1984 Stevenson
4,513,969 A 4/1985 Samsel
4,515,367 A 5/1985 Howard
4,586,712 A 5/1986 Lorber
4,770,421 A 9/1988 Hoffman
4,807,884 A 2/1989 Breeding
5,374,061 A 12/1994 Albrecht
5,382,024 A 1/1995 Blaha
5,669,816 A 9/1997 Garczynski
5,683,085 A * 11/1997 Johnson ..... A63F 1/12 273/149 R
5,722,893 A 3/1998 Hill
5,989,122 A 11/1999 Roblejo
6,149,154 A 11/2000 Grauzer
6,254,096 B1 7/2001 Grauzer
6,267,248 B1 7/2001 Johnson
6,299,536 B1 10/2001 Hill
6,402,142 B1 6/2002 Warren
6,629,894 B1 10/2003 Purton
6,637,622 B1 10/2003 Robinson
6,651,982 B2 11/2003 Grauzer
6,655,684 B2 12/2003 Grauzer
(Continued)

*Primary Examiner* — Michael D Dennis
(74) *Attorney, Agent, or Firm* — Chris Tanner; BlueCollarIP.com

(57) ABSTRACT

The invention herein describes a casino grade card handling device used for randomizing playing cards that includes an integral card delivery shoe which allows dealers to access a continuous supply of shuffled cards. The device can operate in a continuous mode and can be programmed to accommodate a variety of different card games, and a variable number of players. The device includes a radial card receiver whose operation advantageously exploits centrifugal force, yielding a configuration that is more compact and requires less manufacturing cost than similar existing devices. The device is designed to be embedded unobtrusively into a casino table or adjacent stand such that its dealing shoe, input portal and control panel are conveniently clustered together and easily accessible to a dealer.

18 Claims, 28 Drawing Sheets

(56) References Cited

U.S. PATENT DOCUMENTS

| | | | | |
|---|---|---|---|---|
| 6,659,460 | B2 | 12/2003 | Blaha | |
| 6,676,127 | B2 | 1/2004 | Johnson | |
| 7,374,170 | B2 | 5/2008 | Grauzer | |
| 7,407,438 | B2 | 8/2008 | Schubert | |
| 7,500,672 | B2 | 3/2009 | Ho | |
| 7,753,374 | B2 | 7/2010 | Ho | |
| 7,766,332 | B2 | 8/2010 | Grauzer | |
| 8,342,525 | B2 | 1/2013 | Scheper | |
| 8,353,513 | B2 | 1/2013 | Swanson | |
| 8,544,848 | B2 | 10/2013 | Blaha | |
| 8,590,896 | B2 | 11/2013 | Krenn | |
| 8,931,779 | B2 | 1/2015 | Grauzer | |
| 9,126,103 | B2 | 9/2015 | Krenn | |
| 9,370,710 | B2 | 6/2016 | Grauzer | |
| 9,623,317 | B2 | 4/2017 | Scheper | |
| 9,717,979 | B2 | 8/2017 | Grauzer | |
| 9,861,881 | B2 | 1/2018 | Grauzer | |
| 9,922,502 | B2 | 3/2018 | Grauzer | |
| 10,226,686 | B2 | 3/2019 | Scheper | |
| 10,456,659 | B2 | 10/2019 | Krenn | |
| 10,632,363 | B2 | 4/2020 | Krenn | |
| 10,814,212 | B2 | 10/2020 | Blaha | |
| 10,864,431 | B2 | 12/2020 | Stasson | |
| 11,376,489 | B2 | 7/2022 | Scheper | |
| 2003/0151194 | A1* | 8/2003 | Hessing | A63F 1/12 273/149 R |
| 2016/0059112 | A1 | 3/2016 | Berube | |
| 2020/0171375 | A1* | 6/2020 | Litman | A63F 1/12 |
| 2020/0353345 | A1* | 11/2020 | Mercer | A63F 1/12 |
| 2024/0009547 | A1 | 1/2024 | Oeding | |

* cited by examiner

FIG. 11
PRIOR ART
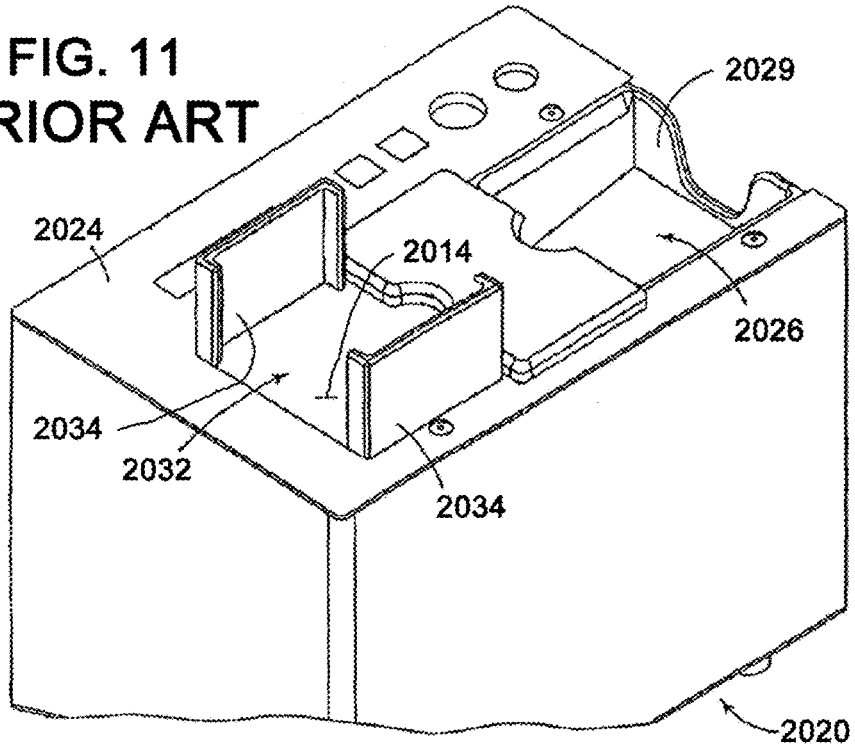
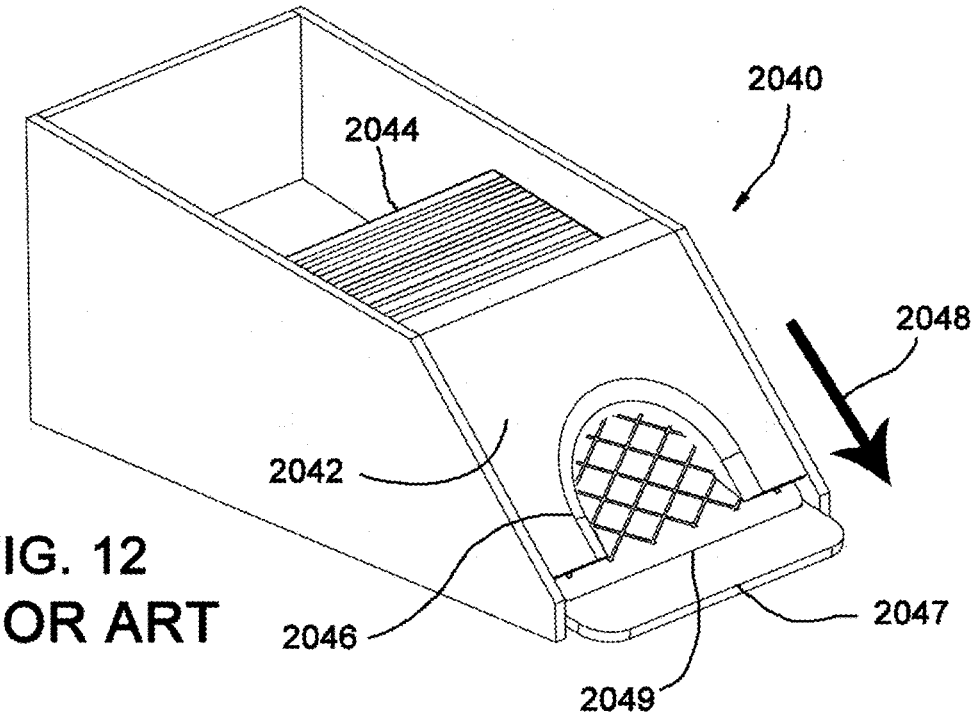
FIG. 12
PRIOR ART

COMPACT CONTINUOUS SHUFFLER

FIELD OF INVENTION

The present invention is related to the field of casino grade automatic card shuffling machines, which are used by casinos to speed up the rate of play of dealer-hosted card games. More particularly, the invention relates to shuffling machines which randomize the rank and suit of cards within multiple decks of playing cards in order to provide a continuous supply of randomized (shuffled) cards to a conventional card shoe for use in various types of card games. These shuffler types are called "continuous" shufflers in the art because they can continuously supply play-ready cards to a card delivery shoe which is integrated into the card shuffling device.

CO-PENDING APPLICATION

Other various methods and device embodiments for implementing shuffling machines are disclosed in co-pending U.S. patent application Ser. No. 18/737,984 which was filed on Jun. 8, 2024 and is incorporated herein by reference in entirety.

BACKGROUND

Casino card games such as twenty-one and blackjack are major attractions in casinos because they are relatively easy to play and allow wagering to various degrees of risk. A single deck of 52 playing cards or multiple decks are used in these games, which must be periodically shuffled to effect randomness of the rank and suit of the individual cards within the decks. The dealer initiates each game by delivering a shuffled (randomized) hand of playing cards to each game participant one-by-one from a card delivery shoe, and thereafter retrieves additional cards from the shoe as needed. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

Mechanized card shufflers quickly randomize card decks and deliver the randomized (shuffled cards) to an output portal. One particular type of card shuffler is called a "compartment shuffler". That name is derived from the operational procedure of sorting cards into substacks within compartments which reside within the device, where the term substack is defined as being a stack of cards comprising two or more cards but less than an entire deck. Ultimately, each substack is delivered to an exit portal where the substack may be individually accessed or may be combined with other substacks.

FIG. 1 illustrates an early playing card shuffler that was described in a 1932 patent granted to R. C. McKay and issued as U.S. Pat. No. 1,885,276 (McKay '276). Groups of individual playing cards are accumulated into substacks in four compartments which are configured radially in a rotating carrier. FIG. 1 is reproduced from the prior art McKay '276 patent which explains that individual cards are separated from an unshuffled deck and randomly accumulated into four compartments. The substacks of cards are retained in each compartmental nest by gravity, and the substacks must be removed from their nests by displacing the card carrier so that the cards may be removed in the same direction from which they were inserted.

Referring to FIG. 1, the rotational housing which carries the four compartments is called the "receiver" 1024, which possesses four compartments 1025 through 1028 for accumulating substacks of randomly selected cards. The receiver 1024 rotates about pivot 1032 to one of four randomly chosen radial positions. A deck of cards is placed into the magazine 1001 which utilizes rubber-tired wheels 1003 to strip individual cards from the bottom of the stack and move them through a slotted opening 1050 under the power of a hand crank. An innovative random selection mechanism using small balls of four sizes is used to randomly position the receiver 1024 to one of four radial positions for collecting the individual cards into compartments 1025 through 1028.

McKay '276 appears to have pioneered the concept of "shuffling" cards by distributing individual cards randomly into a plurality of compartments. Indeed, the 1932 patent is entitled AUTOMATIC CARD SHUFFLER AND DEALER, and teaches an innovative randomizing configuration which was implemented without the aid of motors or microcontrollers.

A later shuffler patent is known in the industry as the "Lorber Design" and was taught by U.S. Pat. No. 4,586,712 (Lorber '712), which was granted in 1986. This classic prior art configuration (shown in FIG. 2) is based upon unloading cards from an unshuffled deck into the individual slots of a carousel, randomly rotating the carousel, and then pushing individual cards from the carousel slots and into a shoe. Each slot in the Lorber '712 carousel holds one card.

As shown in the upper section of FIG. 2, an unshuffled card stack 2053 is deposited on edge into container 2052 of the automatic shuffling apparatus 2050. Individual cards are vertically stripped from the stack and moved downward from the left end of container 2052 and into a carousel 2062 by driven rollers 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within carousel 2062. Individual cards are extracted from the randomly rotated carousel 2062 at the station shown in the bottom left section of the figure by the action of an "ejecting device" 2066. Driven rollers 2054 and 2055 move the individual cards into a newly created stack within space 2068. The stack of cards within discharge portal 2068 has thus been arranged randomly (shuffled).

Rather than arranging the card storage compartments within a circular carousel, other early shufflers utilized compartments configured in a vertical stack. Prior art 1988 U.S. Pat. No. 4,770,421 to Lionel Hoffman (Hoffman '421) teaches a stack of "mixing pockets". Referring to FIG. 3A, which is reproduced and annotated from that patent, the six mixing pockets 934A through 934F are arranged in a linear stack. The Hoffman '421 specification explains that cards are individually inserted into a randomly chosen compartment within the stack of mixing pockets, accumulated, and then extracted in groups from the mixing pockets in a random order. The specification explains;

> According to a more particular form of the invention, a card shuffler is provided comprising a plurality of mixing pockets for holding cards, and card holding and distribution means for holding a stack of cards and for distributing and transferring one card at a time in sequence to said mixing pockets in accordance with a first distribution schedule. (Hoffman '421 1:61-67)

The compartment shuffler art has since generally evolved into myriads of disclosures that are characterized by their storage compartment configurations. A large group of more recent shuffler disclosures utilize linear stacks and elevators, and another large group of more recent disclosures utilize circularly-arranged storage exemplified by drums and carousels.

A more recent compartment shuffler is taught by prior art U.S. Pat. No. 6,659,460 which was granted in 2003 to Ernst Blaha (Blaha '460), as shown in FIG. 3B. Blaha '460 also incorporates a carousel configuration which is similar to the Lorber design, but Blaha '460 differs from its predecessor by configuring the carousel slots to accumulate multiple cards. In this way, Blaha processes the cards in the form of substacks.

Referring to FIG. 3B, unshuffled cards 313 residing in an unshuffled card station 310 (upper left) are transported by feed rollers 314, 315, 318 and 319 into compartments 369 of the "rotatably held drum" 302. The rollers 318 and 319 are unable to fully insert the cards into the compartments, thus requiring a first pusher 316 which is driven by a motor 323 through eccentric link 322. The pusher 316 pushes each card through the final small movement into the compartments 369 of the drum 302. The drum is rotated by motor 308 to random loading positions as commanded by a microprocessor such that each compartment may accumulate a series of randomly selected cards.

The drum compartments are unloaded to a second station 342 by a second pusher linkage 335 and 337 which is actuated by a motor-driven eccentric 338. After each card is pushed sufficiently into the friction rollers 340 and 345, those rollers move the cards to the "card storage means" 342, as driven by motor 341. Blaha '460 uses two motors to insert each card into the drum, and another two motors to extract each substack.

FIG. 3B visually explains why carousel shufflers are spatially inefficient, leaving a large unused space in the center of the carousel and separating the input portal from the output portal by a relatively large distance. Many motions are required to move cards from the input portal to the output portal. The Blaha '460 drum must rotate through several rotation cycles to accumulate substacks, and then must rotate again to disgorge those substacks. While rotating, the substacks of playing cards in each compartment of the Blaha '460 carousel are subjected to centrifugal forces which try to propel the cards outwardly from their compartments during each excursion. The magnitude of the centrifugal forces is dependent upon the acceleration used to rotate the drum 302.

Blaha teaches that the substacks are retained in opposition to the centrifugal force by clamping the stacks with springs which are provided within each compartment of the carousel. FIG. 4 shows the leaf springs 351 and 353 as reproduced from the '460 patent figures. The disclosure explains that the "springs insure the clamping of the card(s) inserted into the respective compartments" (Blaha '460 4:13-14).

The acceleration used for rotation of the Blaha '460 drum is limited by the clamping force of the springs. FIG. 5 illustrates the physics of the clamping force. This vector diagram explains that the retaining spring 501 must exert sufficient force against the face of the cards to counteract the centrifugal force. Referring to FIG. 5, a card substack 5005 is shown resting on the floor 5007 of a compartment of a carousel that rotates about axis 5008. The arrow 5010 represents the angular acceleration which imposes a centrifugal force $F_C$ upon the card substack 5005. A resistance force $F_R$ must be created by the spring 5001 to counteract the centrifugal force and prevent the card stack from flying out of the compartment. The spring acts upon a bearing pad 5003 which bears against the surface of the stack. The resistance force is given by:

$$F_R=\mu N$$

where: μ is the friction coefficient between the bearing pad and the cards

N=normal force imposed by the spring which is $F_S$

Thus, $F_R=\mu F_S$

For equilibrium, the resisting force $F_R$ must at least balance the centrifugal force $F_C$:

$$F_C=F_R=\mu F_S$$

Since playing cards are intentionally designed to have slippery surfaces, the friction coefficient between cards in a stack is relatively small. This small friction coefficient exacerbates the clamping friction problem. As seen by the clamping equation, a relatively large spring force must be used to counteract centrifugal force when the friction coefficient is small. Conversely, the spring force is limited by the force required to push the cards into the substack during loading of the compartment. Ultimately, these limitations limit the number of cards that can be held against centrifugal force in a single carousel compartment. The result is that carousel shufflers that handle multiple decks of cards need to have large numbers of compartments, with each compartment holding relatively few cards. The Blaha '460 compartments hold "up to nine cards" (Blaha '460 4:29-30). In contrast, the card handling device being claimed herein may hold at least twenty-seven cards in each compartment, thus requiring far fewer compartments.

The magnitude of the retaining spring clamping force requires that the Blaha device uses a first motorized "pusher" mechanism to insert cards into the compartments and a second motorized pusher mechanism to extract the cards from the compartments. These pusher mechanisms, which push against the edge of each card, are required to overcome the clamping forces imposed by the retaining springs in each compartment as each card is slid into the pre-existing stack. One of ordinary skill recognizes that those two motorized "pusher" mechanisms would not be necessary if the substacks were held loosely in each compartment of the Blaha '460 carousel and retained in the direction of the centrifugal force.

The response time of the Blaha shuffler is also limited by its own carousel configuration. The carousel must rotate approximately 180 degrees for moving any card from the input portal to the output portal. Additionally, the rotational acceleration is limited by the clamping force able to be exerted upon the uppermost card in each stack by the retaining springs. The relation between clamping force and rotational acceleration is thus a design compromise which places an upper limit on carousel acceleration. As will be seen herein, centrifugal force can be advantageously utilized in a card handling device, rather than being problematic as in the Blaha configuration.

Prior art U.S. Pat. No. 6,149,154 was granted to Attila Grauzer et al in 2000 (Grauzer '154) and describes another compartment shuffler where the carousel compartments are unwound into the form of a linear elevator. The elevator consists of card accumulation compartments which are moved linearly rather than rotationally. FIG. 6 shows an illustration reproduced from the '154 patent showing the side view of the device, including the "hand receiving platform" 836, the "card moving mechanism" 830, the "rack assembly" 828, and the card receiver 826 "for receiving a group of cards for being formed into hands". Operation is understandingly similar to the carousel devices. Cards are randomly inserted into slots of the elevator at one station, and thereafter randomly pushed from slots at another station. Cards cannot be moved directly from the input portal to the discharge portal.

Referring to FIG. 6, Grauzer '154 teaches an elevator with nine compartments called a "rack assembly" which traverses up and down in the direction of arrow 884. Unshuffled card decks are placed into the unshuffled card receiver 826 against the surface 870 of a moveable block 868, and individually propelled in direction of arrow 882 by motorized rollers 850, 862 and 864 into the compartments of the rack assembly 828 at the loading station 830. An elevator motor 842 and timing belt 840 move the rack assembly upwards and downwards to align randomly chosen compartments with arrow 882. Thereafter, each card is inserted into a randomly chosen compartment and temporarily accumulated with others. This type of shuffler utilizes each compartment to form "hands" which are ready for distribution directly from each compartment. A microcontroller counts the number of cards inserted into each randomly chosen compartment. When a given compartment reaches the capacity of cards required for a hand, no more cards are entered into that compartment, and the compartment is considered ready for disgorgement.

When enough compartments are filled to the hand capacity needed for the number of players, the shuffler is then ready to disgorge substacks (hands). A pusher mechanism 890 is located at a lower station and used to push the substacks out of the compartments in the direction of arrow 886 and into the "hand receiving platform" 836. In comparison to the carousel shuffler designs, Grauzer '154 teaches that only nine (9) compartments are required for proper randomization in a hand forming shuffler.

In the Grauzer '154 configuration, the substacks are retained within each elevator compartment by gravity. Thus, a motorized "pusher mechanism" is needed for removing the substacks from the elevator compartments to the hand receiving platform 836. FIG. 7 is a reproduction from another figure of the Grauzer '154 patent that explains the card removal pusher mechanism in more detail. The elevator positions the compartment requiring extraction at a level occupied by a "pusher' mechanism as aligned with arrow 886. The substacks are thereafter pushed out of the compartment 892 allowing the substack to fall by gravity into the hand receiving platform 836. Grauzer '154 describes the pusher 890 as a "rack". The passage below paraphrases a section of the Grauzer disclosure where the label numerals are altered to the equivalent labels used herein.

> The pusher 890 includes a substantially rigid pusher arm in the form of a rack having a plurality of linearly arranged apertures along its length. The arm 890 operably engages the teeth of a pinion gear 896 driven by an unloading motor 898, which is in turn controlled by the microprocessor. At its leading or card contacting end, the pusher arm 890 includes a blunt, enlarged card-contacting end portion. (Grauzer '154 12:56-67)

Grauzer '154 describes the well-known commercialized "hand forming" shuffler manufactured by ShuffleMaster, called the ACE Shuffler®. The elevator is referred to as a "rack assembly" in the disclosure and consists of eight "hand forming" compartments and a ninth oversized compartment for accumulating the unused cards which remain after all of the required hands have been formed. The oversized compartment is located centrally within the elevator and indicated by label 894 in FIG. 7. The disclosure explains that eight compartments are sufficient for statistical randomization of a deck (52 cards) in the following paraphrased passage.

> Preferably, the rack assembly 828 has nine compartments. Seven of the nine compartments are for forming player hands, one compartment forms dealer hands and the last compartment 894 is for accepting unused or discard cards. It should be understood that the device the present invention is not limited to rack assembly with seven compartments. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. (Grauzer '154 8:66-67, 9:1-10)

The oversized compartment 894 shown in FIG. 7 is required to collect the unused cards from the unshuffled card receiver. The unused cards must be temporarily stored in the rack assembly because there is no direct path from the unshuffled card receiver to the hand receiving platform.

While many theories exist regarding the number of compartments needed for playing card randomization, the commercial success of the "hand forming" ACE shuffler reinforces the fact that eight compartments are sufficient in practice for randomizing cards while forming play-ready hands. Configuring a "hand forming" shuffler with more than eight compartments therefore creates unneeded compartments from the viewpoint of commercial viability.

A goal of several prior art automatic shufflers is to position the shuffling device below the casino table surface so as to make the device unobtrusive. FIG. 8 is excerpted from prior art US patent Application US2020/0171375 A1 which was filed in December 2018 by inventor Mark Alan Litman (Litman '375). The Litman '375 disclosure teaches that the device disclosed in FIG. 7 may be embedded within a housing or table such that the uppermost casing surface 940 resides flush with the table surface. An elevator 930 is described for receiving shuffled cards. The elevator appears to be functionally equivalent to a container for temporarily storing stacks of shuffled cards. In one embodiment, the elevator 930 is removed from the device manually using a handle 918. In another embodiment, undisclosed mechanical means are used to lift the elevator housing. The disclosure explains;

> FIG. [8] shows a manually lifted elevator [930]. (Litman '375 @ [0046])
>
> There may be gear drives, friction wheels, chain gears and the like (not shown) adjacent the sides of the elevator [930] to raise the elevator if that is preferred to a manual lift. (Litman '375 @ [0048])

By embedding the "hand-forming" shuffling device of FIG. 7 within a table, Litman '375 teaches that the cards located at the base of the elevator 924 are not accessible to the device operator, with the consequence that hands formed by the shuffler cannot be sequentially delivered to the players as they are delivered to a delivery tray. The disclosure fails to teach any mechanism for sequentially moving individual substacks of cards to a delivery tray that is accessible by the device operator.

A secure operational mode is one feature of the card handling device being claimed herein. The prior art teaches that automatic shuffling machines have traditionally utilized image sensors to ensure the integrity of a card deck by sensing and tracking the identity of every card within a deck or decks during the shuffling process. Contact Image Sensors (CIS) were invented in the 1970's for use in facsimile machines and have since been adopted for image sensing in various shuffling machines. Similarly, CMOS image sensors invented for use in digital cameras and scanners have also been adopted in the shuffler art. Numerous prior art references teach optical recognition devices that read identification marks and/or indica on each card to verify that the deck is complete and does not contain extraneous cards. The prior art teaches a myriad of automatic shuffling machines which verify that each and every card of each suit is included as required by the game being played, and that there exists no missing or extraneous cards resulting from machine malfunction or cheating.

For example, prior art U.S. Pat. No. 5,989,122 (Roblejo '122) appears to have pioneered the use of optical recognition sensors that are utilized to verify card deck composition. The Roblejo '122 embodiment is reproduced in FIG. 9 and discloses an automatic shuffler that utilizes an optical card reader 2044 which reads rank and suit of individual cards before they are moved from an unshuffled input stack 2042 to its randomizing mechanism. The role of the optical recognition device is to verify the composition and completeness of a set of playing cards prior to randomizing. Referring to FIG. 1, Roblejo '122 explains that an apparatus 2040 has a control means 2041, an input means for receiving playing cards onto an input stack holder 2042, and buffer means having a plurality of slots for temporarily holding cards, illustrated as a wheel 2043 (carousel) having a plurality of slots 2048. The apparatus additionally possesses identification means for reading indicia, illustrated as bar code reader 2044 to determine identity of playing cards which can be specially marked with bar codes or other coded information. Alternatively, the cards can be unmarked.

> "It is an object of this invention to provide an apparatus and method for receiving cards, either from new decks or after the cards have been played, to shuffle the cards in a randomized order, and simultaneously to verify the accuracy of the set or sets of cards in the deck or decks. (Roblejo '122 col. 2; lines 22-27)
>
> "The means for reading indicia is preferably either a bar code reader, Video optical System, optical Scanner, reader of hologram information, or reader of magnetic indicia (Roblejo '122, col. 3; lines 65-67)".

An excerpted illustration from prior art U.S. Pat. No. 6,629,894 (Purton '894) is shown in FIG. 10 and teaches alternative configurations of a digital camera (commonly known as a CMOS camera) arranged to inspect rank and suit of each card as a machine passes each card from one stack to another. Cards from a card stack 2000 on platform 2001 are fed from the bottom of the stack via a drive roll 2002 to pinch rolls 2007, which facilitate movement to card stack 2005. In one embodiment the cards of card stack 2000 are face down and a first camera 2003 reads the face of the cards within the card stack 2000 via a window 2004 of the platform 2001. Alternatively, digital camera 2006 can be mounted below the pinch rolls 2007 such that a face of the card can be read between the card stacks 2000 and 2005. In another embodiment, a camera 2006 is above the pinch rolls 2007 to read any cards that are face up between card stacks 2000 and 2005.

Purton '894 states:

> "The camera reads the face of the cards and using on board image processing, provides a data output which includes the suit and value portion of the face of the card. (Purton '894 col. 5; lines 67, col. 6; lines 1-3)

Shuffling machines are relatively slow devices because they must handle each and every card in the deck, both to randomly rearrange its deck position and to verify its proper authenticity and existence. One way to sustain rate of table play in a casino is for the dealer to utilize a "two-deck rotation". Shuffling machines which facilitate the "two-deck rotation" usually possess an unshuffled card intake portal and a shuffled card output portal and are physically located near the casino table. Such a prior art example is shown in FIG. 11 as taught by U.S. Pat. No. 6,651,982 (Grauzer '982), where the recess 2026 is a card receiving area for receiving unshuffled cards, and the recess 2032 is a shuffled card return area. The unshuffled cards are released into the mechanism below the recess 2026 where they are randomly rearranged and thereafter raised to the recess 2032 by elevator surface 2014. Shuffling of another unshuffled deck (or decks) is able to commence only after the newly-shuffled deck (or decks) are removed from the elevator surface 2014 by the dealer.

While the shuffling machine is shuffling the previously "played" deck (or decks), the dealer uses a newly-shuffled deck (or decks) to execute the game with the players. When that deck (or decks) are reasonably depleted, the dealer can then return that deck (or decks) to the shuffling machine and fetch a newly-shuffled deck (or decks) from that machine, such that there is relatively little interruption in play. While the game is being played with one deck (or decks), a newly-shuffled deck (or decks) are being made ready within the automatic shuffler.

Following a shuffling cycle, a dealer removes the shuffled cards from the discharge portal 2032 and moves them to a card delivery shoe that is located on the casino table. A conventional multi-card delivery shoe 2040 is shown in FIG. 12 wherein a plurality of cards 2044 are stored and wherein a dealer may withdraw each card 2049 rapidly with a downward motion along the surface of an angular draw plate 2042 in the direction of arrow 2048 by swiping his/her finger through finger opening 2046. A wedge-shaped member (not shown) resides behind the card stack 2044 and pushes the stack toward the inner surface of the draw plate 2042. The rendering in FIG. 12 is made directly from a CAD (computer-aided design) model of a commercially available shoe having a capacity of four decks.

The dealer also has a card discharge rack on the casino table where he/she deposits cards that have already been utilized in a card game. The dealer moves those cards from the discharge rack to the unshuffled card input portal of the automatic shuffler when it is appropriate to initiate a new shuffling cycle.

Some shuffling machines, including the card handling device being described herein, have the goal of operating in a continuous mode wherein the shuffling device contains an integral card delivery shoe which is continuously replenished with shuffled cards from within the randomizing mechanism. A dealer returns the "spent cards" (already played) to the input portal of the shuffling machine at the end of each game round, and the returned cards are mixed with those already existing within the shuffler. The term "continuous" is derived from the fact that no stoppage is required to shuffle the card supply. Rather, the shuffling is conducted continuously as long as some amount of cards reside in the input portal. Continuous shufflers in the art are characterized by the capacity to continuously shuffle from one to eight decks.

A natural goal for a continuous shuffler is to integrate the card delivery shoe with the shuffling device such that the shoe functions as the output portal. Prior art U.S. Pat. No.

9,370,710 B2 teaches such a configuration as shown in FIG. 13. This patent was issued in June of 2016 to Attila Grauzer et al (Grauzer '710) and disclosed a linear compartment shuffler. This device is similar to the prior art device in FIG. 6 with the addition of a card delivery shoe 2057. Cards are moved from the input portal 2053 into compartments 2054 where they are accumulated into substacks. Substacks within each compartment 2054 are thereafter individually pushed into the shoe 2057 by a motorized pusher 2052 which is driven by motor 2056 and sprocket 2055. FIG. 14 illustrates a view of device 2050 with its casing covers as it would appear on a casino table. Since the card delivery shoe must reside upon the table surface, this configuration results in a rather large device which rests obtrusively upon a casino table surface.

Less obtrusive continuous shufflers configure the card delivery shoe as an integral part of the shuffling device with the randomizing mechanisms residing below the table surface. FIG. 15 is excerpted from prior art U.S. Pat. No. 10,814,212 B2 to Ernest Blaha (Blaha '212) which was granted in October of 2020. This configuration allows the card delivery shoe 2102 to reside upon the surface of table 2128 at an elevation above a carousel 2104 whose housing is mounted upon the edge of table 2128, allowing the randomizing mechanism to reside unobtrusively at an elevation below the table surface. Unshuffled cards are placed into a rotatable magazine 2114 which rotates about pivot 2110 in the direction of arrow 2112 to a closed position shown as 2120. When in the closed position, transport rolls 2108 move cards from the magazine into the carousel 2104. Cards are removed from the carousel at a different station by a pusher 2105 (not described) and transported into the shoe 2102 by rolls 2116 and rolls 2118. The physical location of an operator control panel is not disclosed, although the disclosure explains that the control system "may include one or more displays" (Blaha '212 14:17-18).

The configuration illustrated in FIG. 15 is however not convenient for a dealer operating in a continuous mode because the cards must be loaded into the shuffler at an elevation below the table. This requires the task of opening and closing a magazine door 2114 at the end of each round of play. The disclosure also describes a multi-compartment carousel 2104 having forty-three compartments (Blaha '212 7:57). As with other carousel configurations, a device with forty-three compartments cannot be made nearly as compact as the device being claimed herein which possesses far fewer compartments. Moreover, carousel devices require motorized pusher mechanisms (sometimes called "packers") to push the cards into the carousel slots, and motorized extractor mechanisms to remove cards from the carousel slots. These motorized mechanisms add extra manufacturing cost.

FIG. 16 shows another shuffling device having a large carousel. This figure is reproduced from prior art U.S. Pat. No. 10,632,363 B2 which was granted to inventor Peter Krenn in April 2020 (Krenn '363). This disclosure describes a large carousel 2144 with thirty-nine compartments and a rather complex overall structure which may be mounted upon the edge of a casino table 2142. The discharge portal 2138 is described in the disclosure as a "substantially flat card output area" and label 2134 is described as the "card intake area". This configuration achieves the goal of locating the discharge portal and input portal adjacent to each other at the surface of a casino table, but however locates the control panel remotely on an angular housing surface.

Krenn '363 lacks a conventional card delivery shoe having a supply of cards for quick removal. Krenn '363 instead describes a discharge portal having a "substantially flat card shoe" (Krenn 363 4:47-48). Since the shoe can accommodate only one card at a time, individual cards must be transported one at a time to the "substantially flat draw surface" (Krenn '363 Abstract) after having been separated from a substack located at an elevation below the shoe. A second card cannot be elevated to the "flat draw surface" until a first card has been removed from that surface.

One goal of the compact continuous shuffler described herein is to introduce a more competitive continuous shuffler than those which are referenced in the above prior art, by achieving discernable manufacturing cost reductions. The card handling device within this disclosure achieves these manufacturing cost reduction goals by eliminating the need for motorized pusher and packer mechanisms and reducing the number of compartments, thus achieving a continuous shuffler that requires less parts, is more compact and is more economical to manufacture than the referenced prior art. For example, most continuous shuffler devices require six or more motors. The compact card handling device described herein requires only four motors.

A second goal of the compact continuous shuffler is to achieve a low profile continuous shuffling device having a multi-card shoe which can reside unobtrusively on or near a casino table in a convenient location adjacent to the poker chip tray. The bezel portion of the device herein achieves this goal by providing a conventional multi-card delivery shoe at the surface of a table which is continuously and automatically loaded by a unique shoe loading mechanism. The conventional shoe is located closely proximate to the input portal and control panel, thus achieving convenience and economy of the dealer's motions.

The card handling device herein advantageously utilizes centrifugal force to retain and align the card substacks in radially-configured nests, thus eliminating the need for clamping devices and motorized pusher mechanisms, and allowing faster rotational excursions (higher acceleration) during the randomized distribution of cards from the input portal to the temporary storage nests. The device described herein also allows cards to be delivered to a slot-less elevator using centrifugal force and to thereafter be moved into a conventional card delivery shoe by utilizing inertia. Up to four decks may be randomized within the card handling device prior to initiating a card game.

The unique features, compact delivery shoe, and cost efficiency advantages of the compact continuous shuffler will become better understood with reference to the descriptions, drawings and claims which are presented below.

BRIEF DESCRIPTION OF THE DRAWINGS

FIG. 11 is an isometric view from a prior art (2003) shuffler patent disclosure.

FIG. 12 is a perspective view of a conventional card delivery shoe.

DETAILED DESCRIPTION

The figures being described as follows are derived from renderings of the CAD models (computer aided design) which are utilized to fabricate the device described herein. In several instances, portions of the bracketry or support structure are made invisible for the purpose of simplifying the explanation of components within the device. The terms upward and downward or similar directional terms are used herein to describe motion in respect to gravity where an upward motion possesses at least one vector component which opposes gravity and vice versa.

Figure 17:
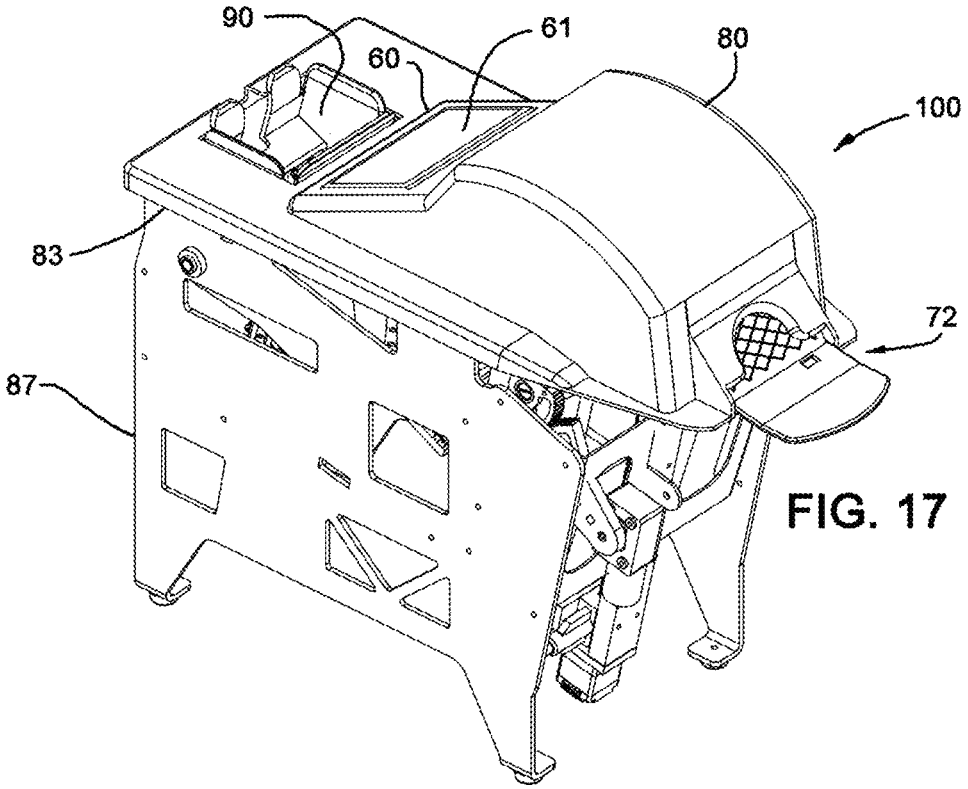
FIG. 17 is a perspective view of the preferred embodiment of the present invention.
Figure 18:
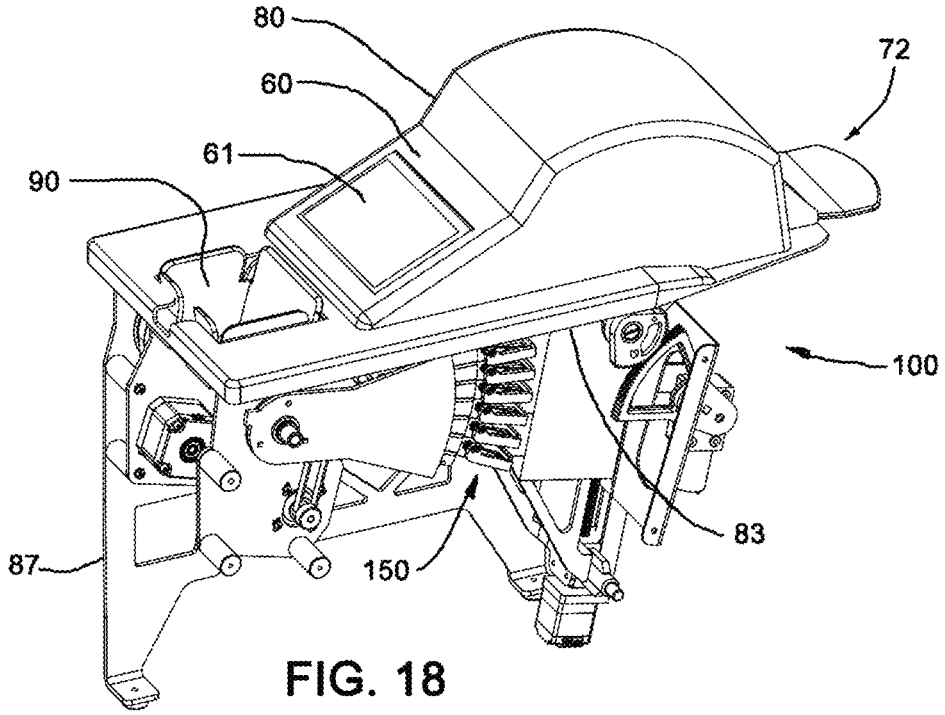
FIG. 18 is an alternate perspective view of the preferred embodiment of the present invention with a sideframe removed.

FIG. 17 and FIG. 18 illustrate isometric views of a preferred embodiment of the card handling device disclosed herein. The card handling device 100 possesses an injection molded bezel 80 and a control panel 60 having a touch screen 61 which is positioned conveniently for a casino dealer on the exterior of the bezel. The device is structurally supported by a pair of side frames 87 which provide structural support for the bezel 80. At least one microcontroller (not shown) controls the operation of the device, including operation of the touch screen. Touch screen 61 is a small 5-inch touchscreen that is used to program the device for various card games. For size reference, a 5-inch touchscreen is slightly smaller than the smaller touchscreens used in today's mobile phones. Prior to each game, the dealer will utilize the touch screen 61 to program the device for various operational modes and game parameters. The touchscreen will also indicate possible malfunctions and security issues to the dealer. For example, the microcontroller may perform various security checks as the cards pass through an inspection station and will issue a warning on the touch screen if an inspection criteria is violated. In a most primitive example, an inspection criteria may be the expected number of cards passing through the inspection station during certain initializing operations.

Input portal 90 is designed to receive and hold multiple decks of unshuffled cards. Upon the command of a dealer or upon a sensor condition, those cards are transported individually into a randomizing mechanism which possesses multiple nests, whereupon each nest is randomly filled with one substack of cards. One side frame and some support bracketry have been made transparent in FIG. 18 for the purpose of viewing the randomizing mechanism which includes a radial nest assembly 150. The microcontroller utilizes a subroutine called a "random number generator" to generate a random address for selecting one of the nests for inserting each card as it is moved from the unshuffled card input portal 90.

A multi-card shoe 72 comprises the discharge portal, having the function of receiving a continuous supply of randomized (shuffled) cards from the randomizing mechanism below. When each nest within the randomizing mechanism has received a substack having a certain threshold number of cards, that nest may transfer its substack to an elevator which carries the substack to the multi-card shoe. A plurality of cards are continuously maintained within the shoe, which is automatically refilled as conditioned by a sensor which counts cards that have been removed from the shoe.

The device is designed to be embedded within a casino table surface or stand and possesses a bezel mounting surface indicated by surface 83 which functions as the device mounting surface. When embedded, only the bezel 80 is visible above the table surface and the bulk of the device resides below the bezel, thus assuring that the device is an unobtrusive occupant of the casino table surface.

Figure 19:
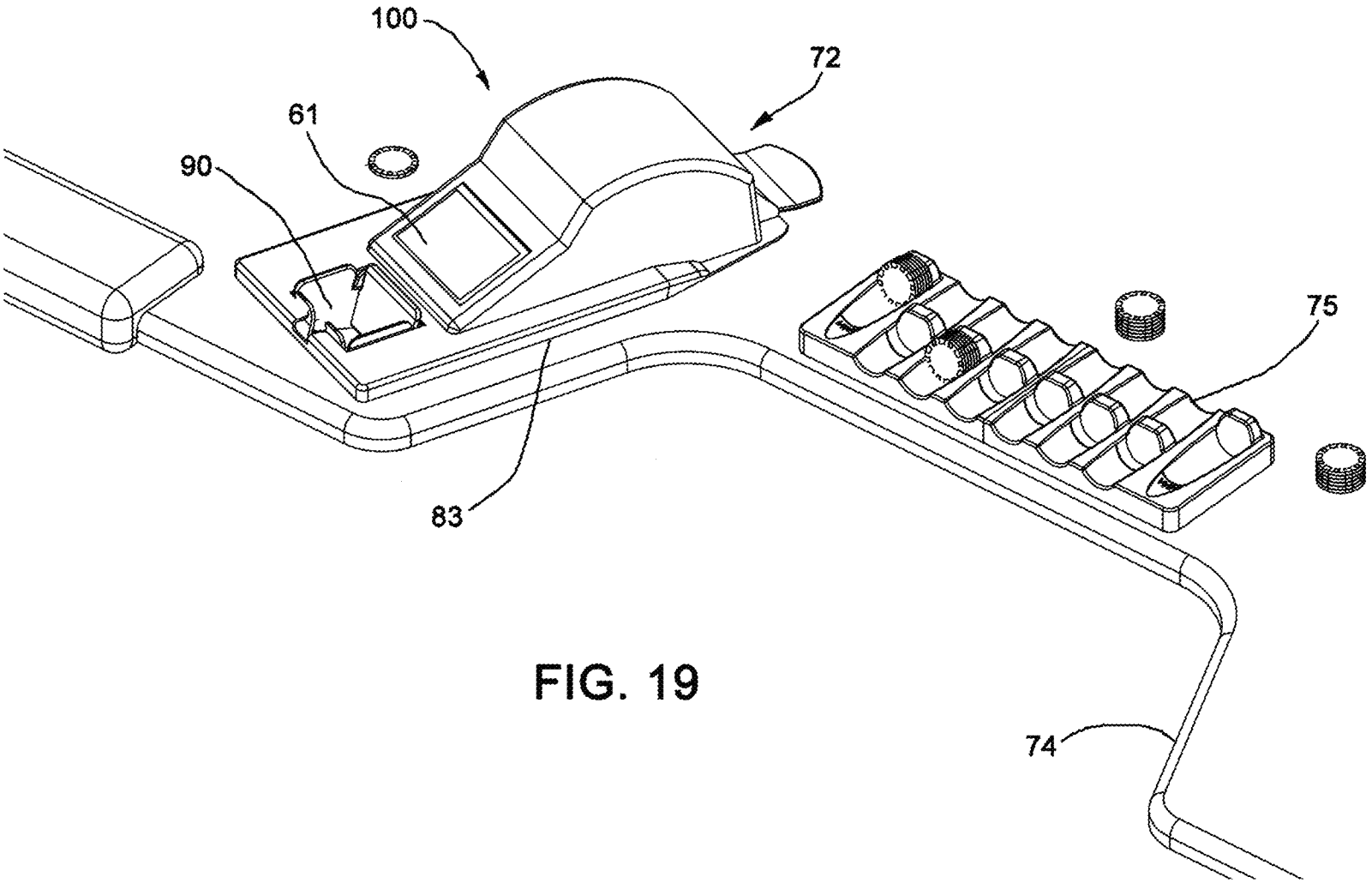
FIG. 19 is a perspective view of the preferred embodiment of the present invention as it would appear in a casino when embedded within a casino table.

FIG. 19 illustrates a preferred embodiment of the card handling device 100 as it would appear embedded within a casino table. This illustration depicts a common type of casino table 74 having a recessed opening in which the dealer stands while overseeing the game. The device 100 is embedded conveniently within the operator's reach and unobtrusively resides adjacent to the poker chip tray 75. Shuffled cards are continuously delivered to the multi-card shoe 72 which resides at the table surface. The closely clustered arrangement of the input portal, touch screen and shoe allows easy access and economy of motion for the dealer.

Figure 20:
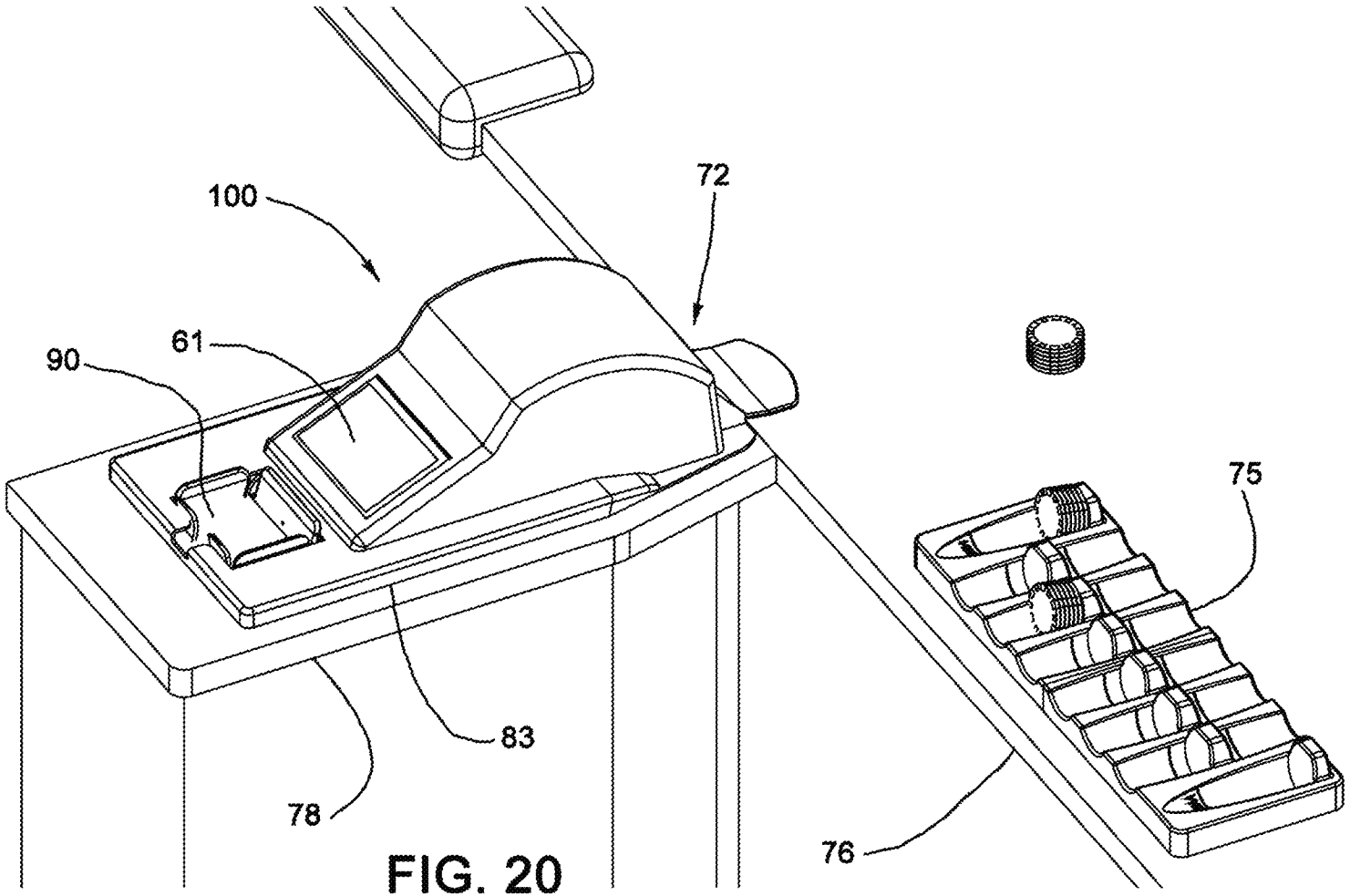
FIG. 20 is a perspective view of the preferred embodiment of the present invention as it would appear in a casino when embedded within a stand adjacent to the edge of a casino table.

Card handling device 100 is mounted upon a side stand 78 which resides along the edge of a casino table 76 in in FIG. 20. The top surface of the side stand is flush with the casino table surface allowing the shoe to lie upon the table surface in an overlapping configuration. The use of a side stand adjacent to the table alleviates the need for cutting out a recess in the casino table and also provides the operator with alternate positions for interfacing with the device. For example, left-handed and right-handed dealers may place the side stand on one side of their body or the other.

Figure 21:
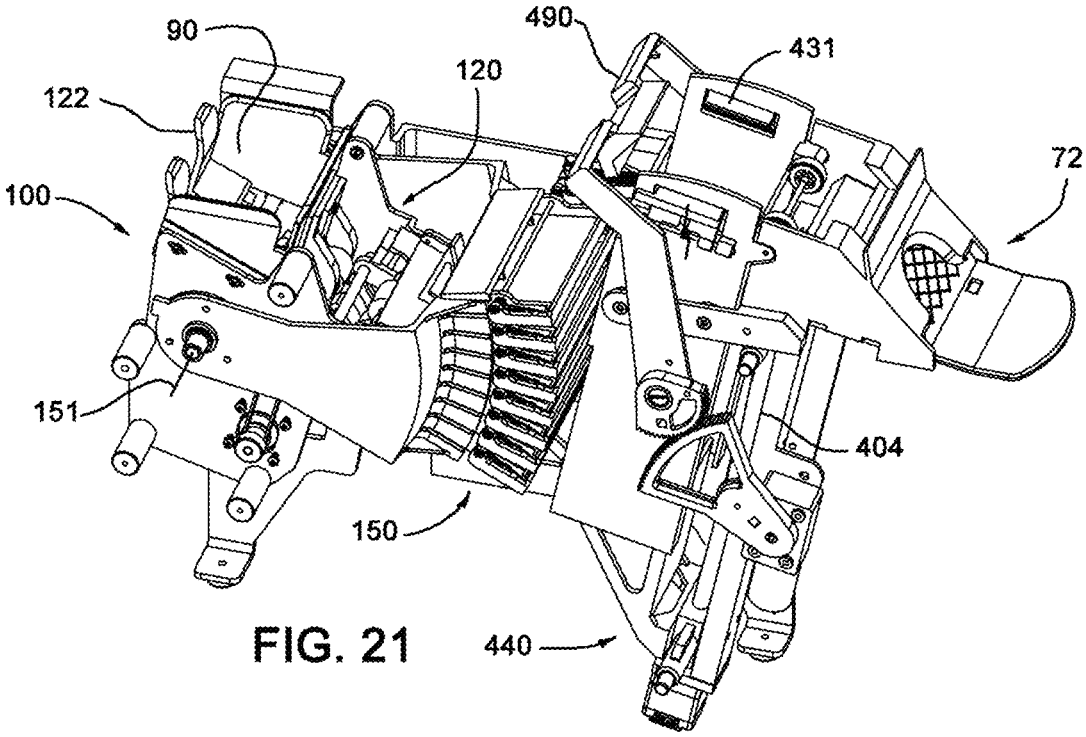
FIG. 21 is a perspective view of the preferred embodiment with its bezel removed.
Figure 22:
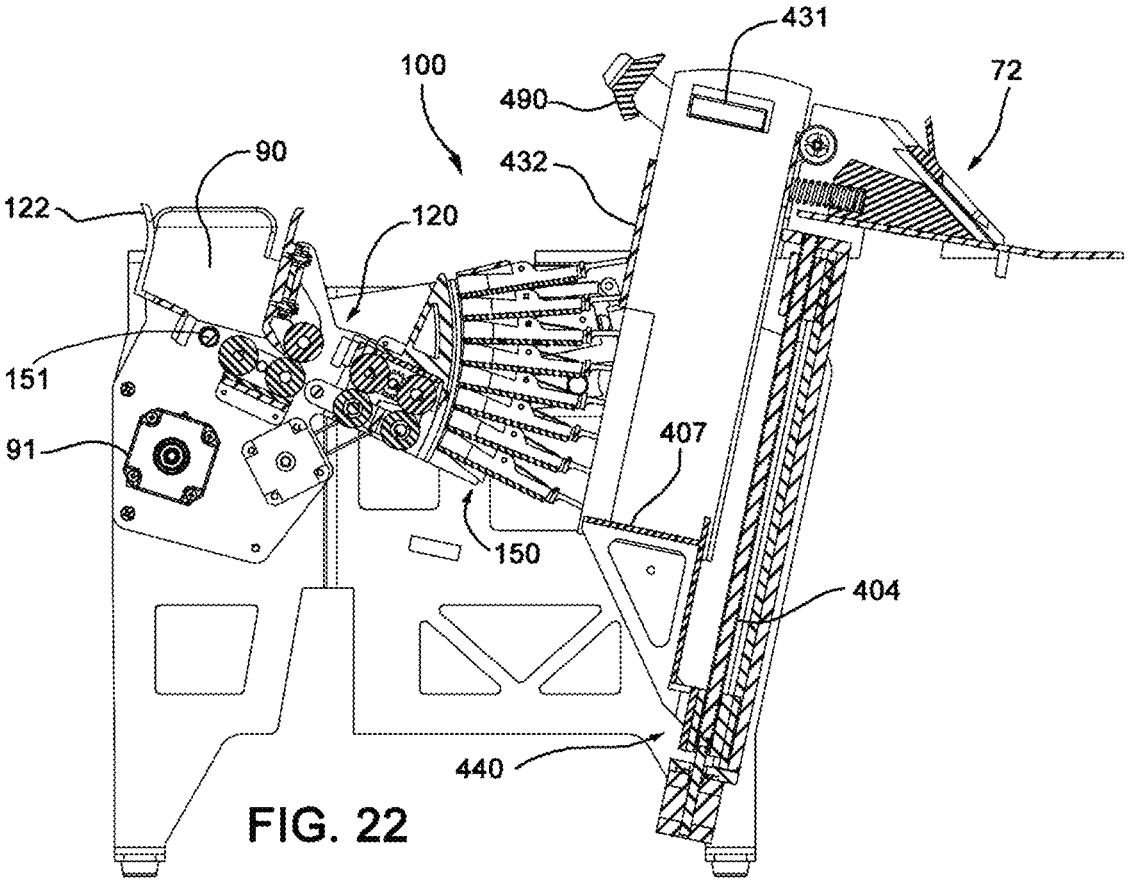
FIG. 22 is a side elevation section view of the preferred embodiment illustrating the internal card movement paths.

An overall view of the internal mechanisms of the card handling device is shown in FIG. 21 where the bezel 80 and the nearest side frame 87 are not shown for the purpose of illustration. FIG. 22 is a side elevation section view showing the same major assemblies as the isometric view of FIG. 21. There are four major subassemblies shown in these two figures, including the card transport 120, the radial receiver 150, the elevator assembly 440 and the shoe assembly 72.

Briefly, feed rolls within the card transport 120 move individual cards from the unshuffled card tray 122 individually into one of eight randomly selected nests within the radial receiver 150, which rotates about axle 151. When the nests have accumulated threshold number of cards to form a substack, the radial receiver 150 may be rotated to discharge the substack in each nest onto the elevator carriage 407. The substacks are thereafter each raised by the elevator lead screw 404 to the multi-card shoe where a pair of support pawls 431 are utilized to strip each substack from the elevator carriage 407. Each substack slides by gravity into a position within the shoe where a rotating yoke 490 thereafter seats the substack into position behind a previous substack.

Figure 23:
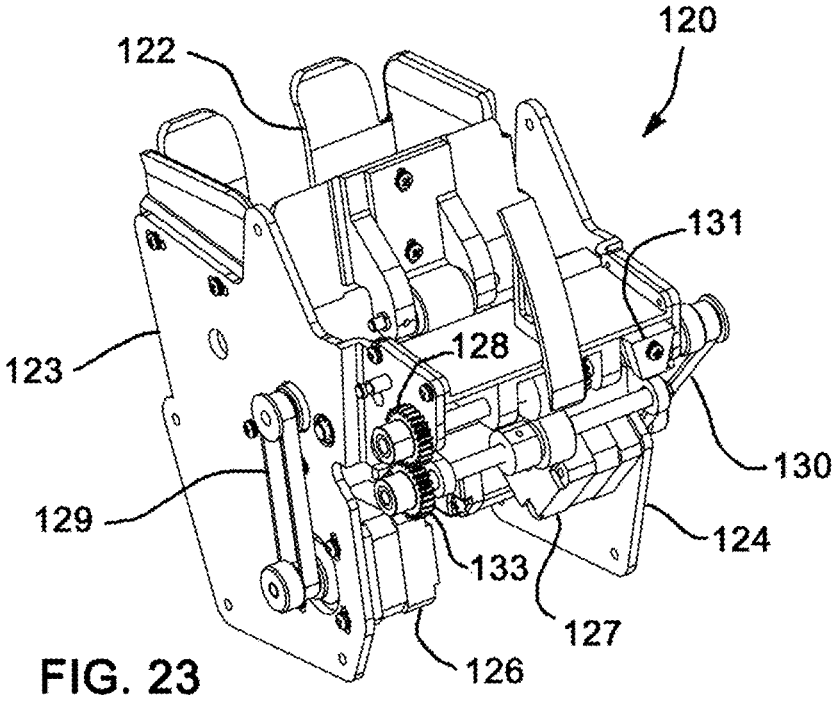
FIG. 23 is a perspective view of the card transport of the preferred embodiment when isolated from the device.

An isometric view of the card transport assembly 120 is shown in FIG. 23. Individual cards are moved from the unshuffled card tray 122 and into the radial receiver 150 by two motors. Motor 126 rotates a set of stripper rolls via timing belt 129 which removes one card at a time from the unshuffled stack. Motor 127 rotates a set of flick rolls via timing belt 130 which accelerate each card into the nests within the radial receiver 150.

Figure 24:
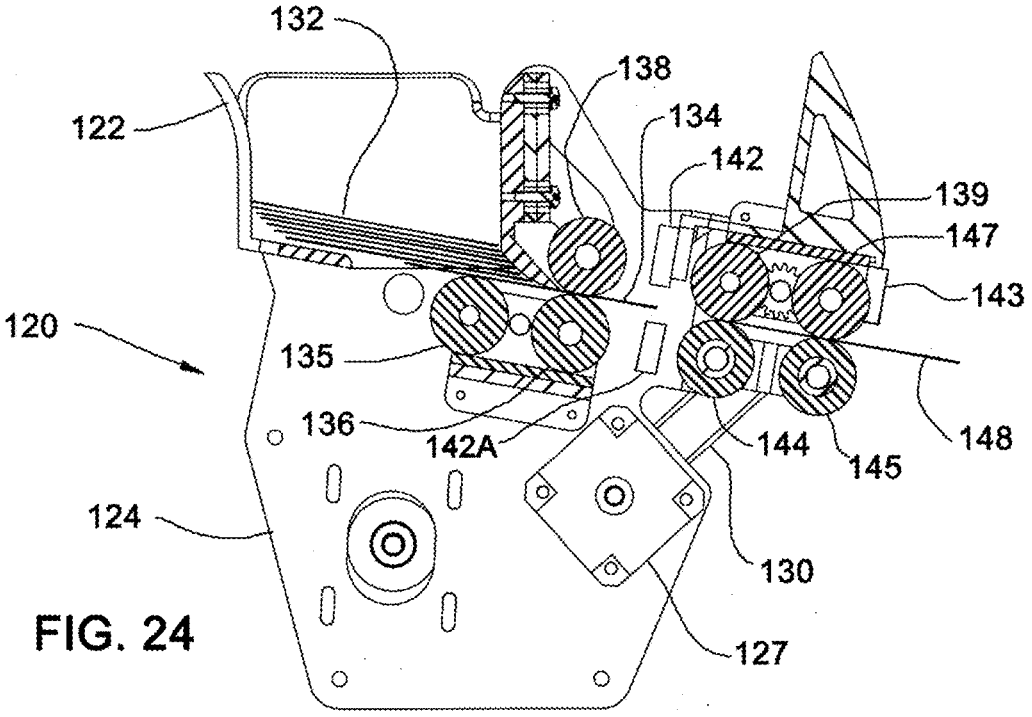
FIG. 24 is a side elevation section view of the card transport of FIG. 23.

FIG. 24 is a section view of the card transport 120 which shows a series of rubber covered transport rolls which illustrate the functionality of the two motors 126 and 127. A stack of cards 132 is shown in the unshuffled card tray 122 where the stack is partially supported by strip roll 135. Motor 126 rotates strip rolls 135, 136 and 138 to "strip" individual cards from the bottom of stack 132 and transports each card until its edge is detected by optical sensor 142. If there exists a second card 148 ahead of card 134, then the strip motor temporarily ceases motion of card 134. The "card path" is defined as the axis defined by an imaginary line along the surfaces of cards 134 and 148.

The optical sensor 142 is utilized to detect the leading and trailing edge of card 148 which is engaged in the forward set of four rolls which are referred to as the "release rolls" 144, 145, 139 and 147. If the trailing card 134 is stopped, then motor 127 will move the leading card 148 with rapid acceleration into the nests of the radial receiver 150. When the trailing edge of card 148 is detected by optical sensor 143, both motors will activate to feed card 134 forward to the release rolls 139, 147,144 and 145. Additionally, optical sensor 143 is used by the microcontroller to count the cards being inserted into each nest.

Additionally, a verification sensor 142A may be located on the opposing side of the card path as sensor 142 for the purpose of identifying each card as it passes along the card path. The term "verification sensor" is defined as a sensor that can interrogate a playing card for interpretation by a microcontroller. In one form, a verification sensor may merely detect a mark or indicia on a card as it moves along a card path such that the microcontroller can confirm that the card belongs to a set. In more sophisticated forms, an interrogation sensor may take the form of a miniature camera that can photograph the indicia's of a passing card such that a microcontroller can interpret its suit and rank as is known in the art. The sophistication of that sensor is a designer's choice from amongst the many types of optical interrogation sensors that are presently known in the art.

Once the newly moved card enters into the forward release rollers (FIG. 24), it will be stopped when its leading edge is detected by optical sensor 143. That card will remain in that state until a randomly selected nest within radial receiver 150 becomes positioned to receive it. After accelerating the forward card from the release rolls into the radial receiver 150, the transport cycle of motors 126 and 127 will be repeated simultaneously with the rotation of the radial receiver 150 to its next insertion position.

Figure 25:
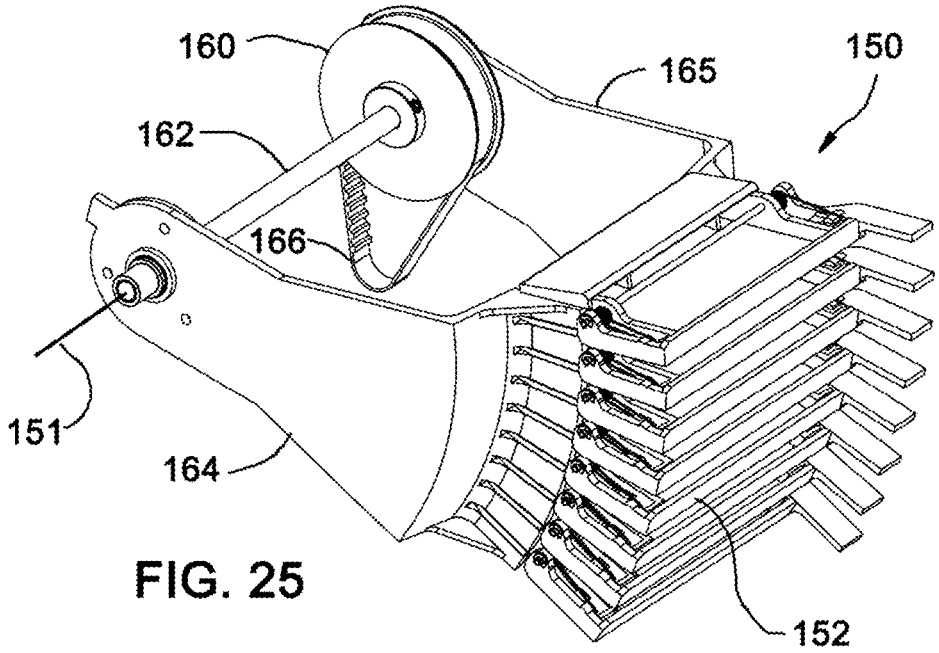
FIG. 25 is a perspective view of the radial receiver of the preferred embodiment.

An isometric view of the rotatable radial receiver 150 is shown in FIG. 25 where this assembly is isolated from the overall mechanism shown in FIG. 21. The radial receiver 150 comprises eight (8) nests 152 which are radially mounted to carrier arms 164 and 165. The entire assembly rotates about axis 151 and is rotationally driven incrementally and bidirectionally amongst the radially-arranged nests by a carrier drive step motor 91 whose location is shown in FIG. 22. The drive motor is connected to the carrier arm 165 by timing belt 166 and pulley 160 which is rigidly attached to carrier arm 165. Angular motion of the entire assembly 150 is controlled by a microcontroller. The microcontroller and drive motor together are capable of rotating the radial receiver 150 with angular precision and with significant angular acceleration while positioning any one of the eight nests into radial alignment with the card path of the card transport 120.

Figure 26:
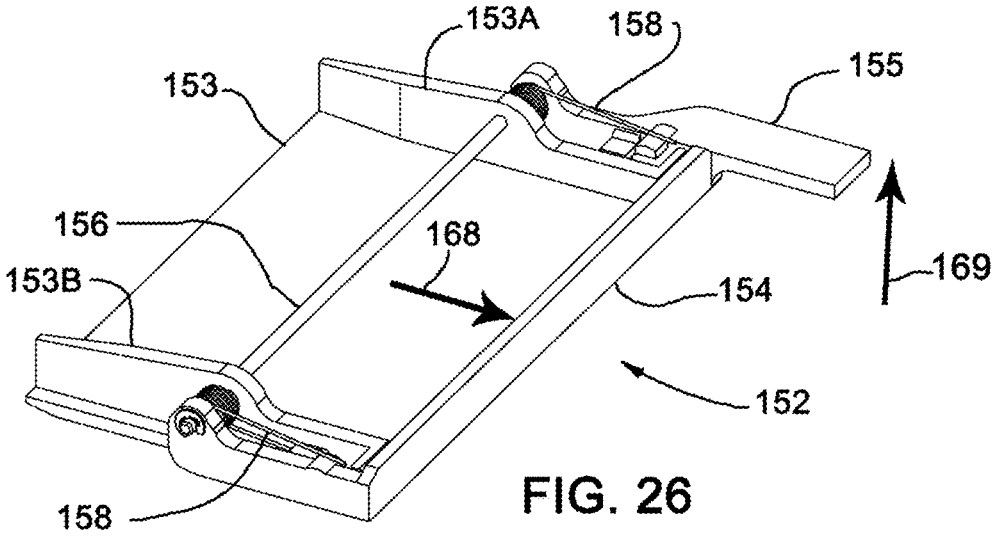
FIG. 26 is a perspective view of the card substack nest of the preferred embodiment.

A single nest 152 is shown isolated in the perspective view of FIG. 26 and comprises a nest base 153 and a movable retainer 154, which are both made of injection molded plastic. Card substacks are retained within the nests laterally by the walls 153A and 153B. The card substacks are retained along the direction of arrow 168 by the retainer 154, where arrow 168 represents the direction of the centrifugal force imposed upon the substack. Movement against actuation arm 155 in the direction of arrow 169 induces retainer 154 to pivot about a stainless steel pin 156 which functions as the retainer's axle. Two torsion springs 158 hold retainer 154 in the position shown during the operational procedures utilized for distributing random cards to the nests. The edges of the accumulated card substacks are forced against the internal edge of the retainer 154 in the direction of arrow 168 by centrifugal force during rotational motion of the radial receiver 150. The centrifugal force acts in a beneficial manner such that the edges of the substacks are aligned by the retainer during the rotational excursions of radial receiver 150.

Figure 27:
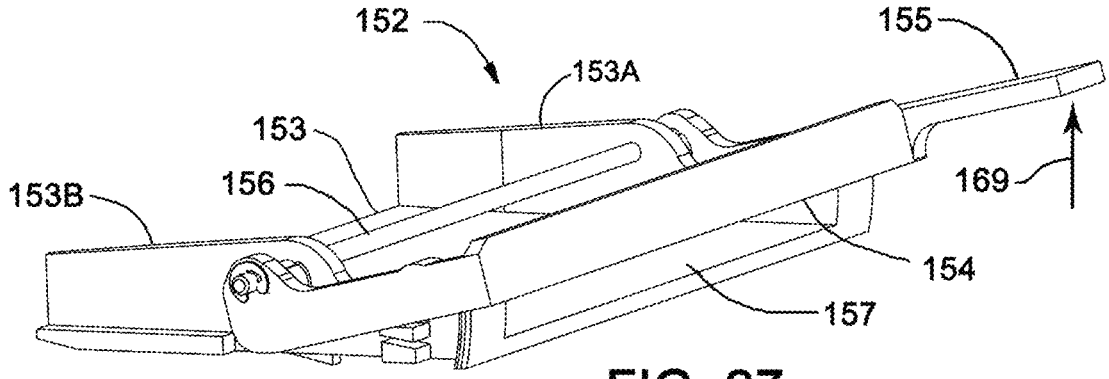
FIG. 27 is another perspective view of the of the card substack nest of the preferred embodiment.

FIG. 27 illustrates the state where the retainer 154 is pivoted to a displaced position, creating an exit orifice 157 which allows the card substacks to escape from the nest 152. The exit orifice is temporarily created by an actuating force that contacts actuation arm 155 in the direction of arrow 169. Movement of arm 155 pivots the retainer 154 about pin 156 against the restoring action of torsion springs 158, thus creating the exit orifice 157.

Figure 28:
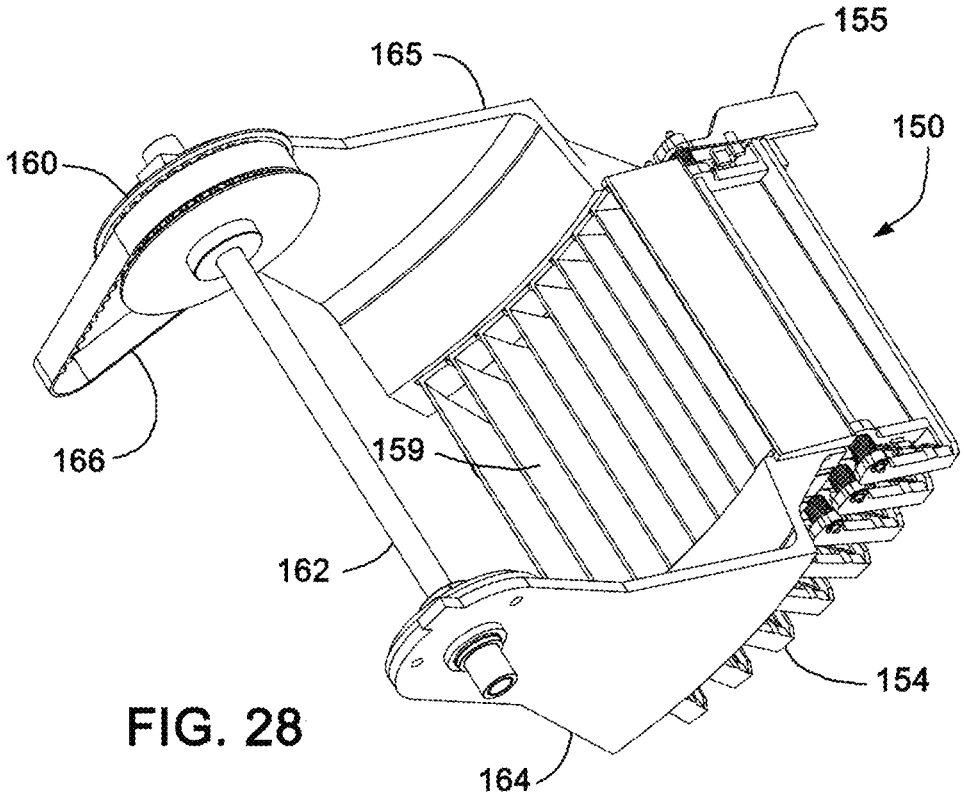
FIG. 28 is a perspective view of the radial receiver assembly of the preferred embodiment.

The entrance orifices 159 to the nests 152 are shown if FIG. 28. This view illustrates the internal nest orifices which are each randomly aligned with the card path of card transport 120 for moving cards individually into the nests 152. Each nest has a capacity of 27 cards which is slightly more than one-half of a card deck. However, the device is programmed in a preferred embodiment to receive no more than 19 cards as a maximum nest threshold value. No additional cards will be directed to a nest that has received 19 cards. The oversize nests guarantee that the card substacks will always be retained loosely within the nests. While the exit orifice 157 (FIG. 27) is sized to allow 27 cards to escape, the entrance orifice of each nest is larger, with an equivalent size of 36 cards. Thus, one characteristic of the preferred embodiment is the distinction that the entrance orifice of each nest is significantly larger than the exit orifice.

Figure 29:
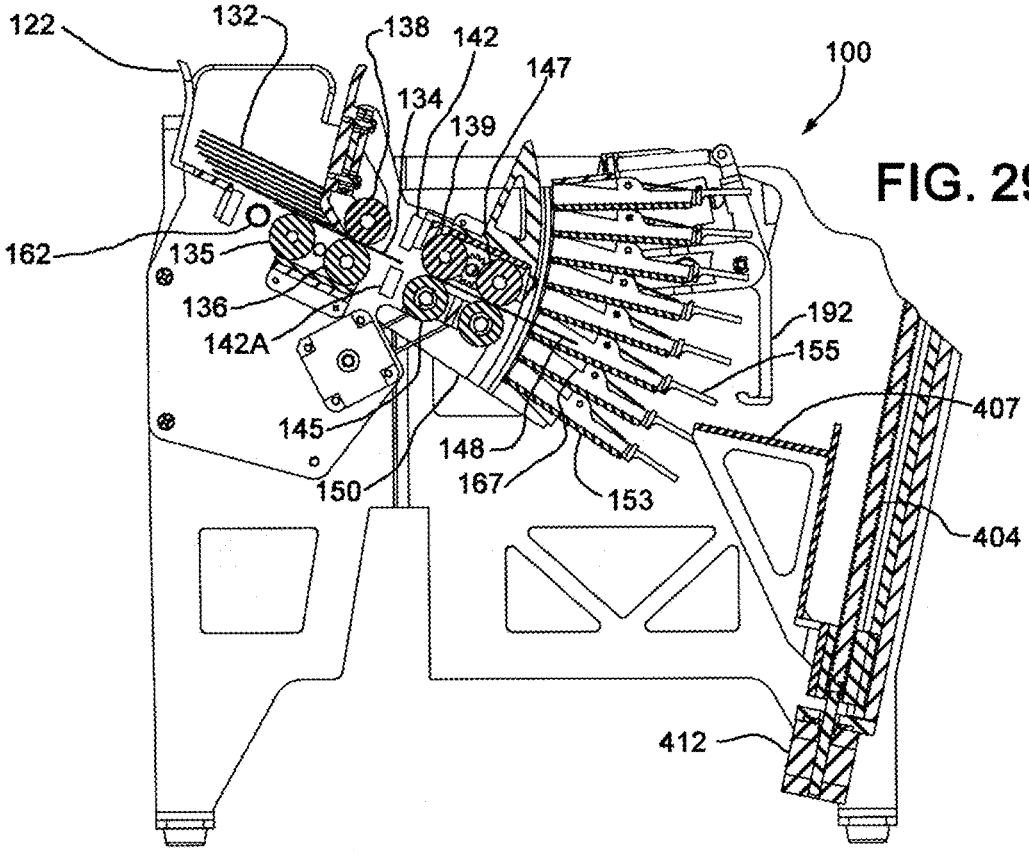
FIG. 29 is a side elevation section view of the preferred embodiment.

A partial side elevational section view of the preferred embodiment is shown in FIG. 29. The bezel 80, the elevator housing 432 (FIG. 22) and the shoe assembly 72 (FIG. 22) have been omitted in this view for explanatory purposes. Only the elevator carriage 407, its driving lead screw 404, and its step motor 412 are shown. Referring to FIG. 29, radial receiver 150 has been rotated about its axle 162 to align a nest (third from bottom) with the card path of the card transport 120. The leading edge of a card 148 is shown entering into the third nest from the bottom of the radial receiver 150. That card is being propelled with acceleration by the release rolls 139, 147, 144 and 145. Each nest base 153 possesses a deflection fin 167 on its lower side, which functions to deflect cards underneath the pivot pin 156. The distance from the floor of nest 153 to the tip of the fin 167 establishes the nest capacity of 27 cards.

Card 134 in FIG. 29 has been advanced until its leading edge is detected by optical sensor 142. It is said to be queued and ready to advance into the release rolls when card 148 enters its target nest. After the trailing edge of card 148 passes the forward sensor 143 (see FIG. 24), the radial receiver 150 will rotate to its next random nest position as directed by the random number generator in the microcontroller. Simultaneously, the card 134 will advance into the release rolls until detected by forward sensor 143 (see FIG. 24). The microcontroller keeps track of the cumulative card count in each nest, and therefore "knows" when that nest is "ready". The definition of a "ready" nest is a nest that has accumulated a threshold number of cards where the threshold number is less than the capacity of each nest. In the preferred embodiment, the nest capacity is 27 cards and the threshold number is set to 19 cards. When a nest achieves the "ready" state, the microcontroller no longer directs cards to that nest. In one embodiment the device 100 will automatically deliver the first substack to the multi-card shoe 72 immediately after any nest achieves the ready state.

Figure 30:
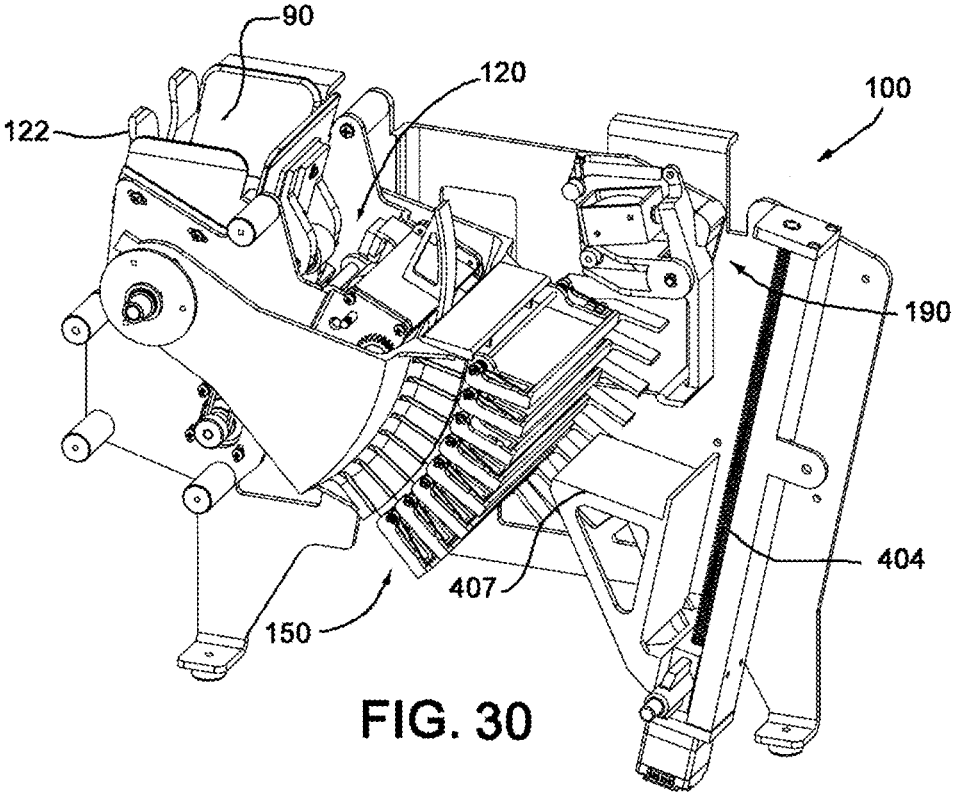
FIG. 30 is a perspective view of the preferred embodiment.
Figure 31A:
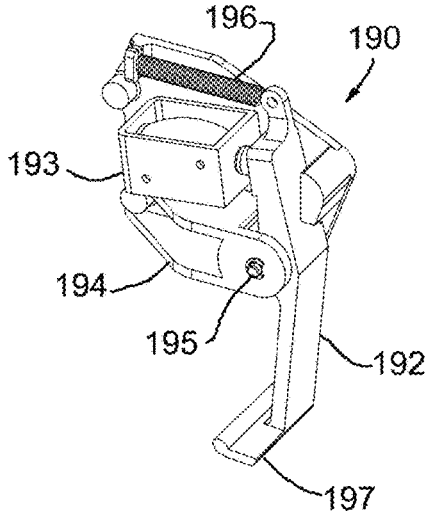
FIG. 31A is a perspective view of the interposer mechanism at rest.
Figure 31B:
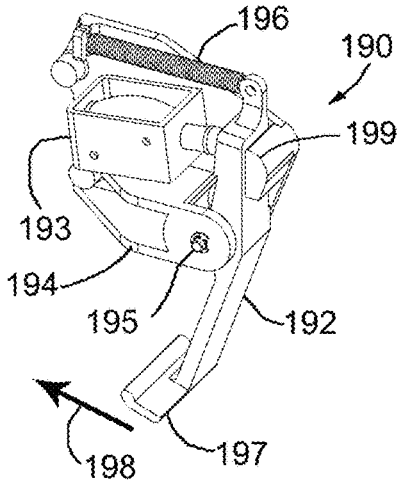
FIG. 31B is a perspective view of the interposer mechanism at actuation.

Centrifugal force moves the substacks from the individual nests of the radial receiver 150 to the elevator carriage 407 after enabling the interposer module 190. Referring to FIG. 30, the interposer module 190 is mounted laterally from the nests and is shown mounted to the rear side frame. FIG. 31A and FIG. 31B explain the operation of the interposer.

Referring to FIG. 31A, the interposer module 190 is shown in isolation. The module consists of an interposer arm 192, a pivot pin 195, an open frame solenoid 193, a return spring 196 and an injection molded mounting plate 194. The interposer 192 is an injection molded component which possesses an actuation finger 197 at its lower extremity. The solenoid is not activated in FIG. 31A and the return spring 196 is holding the interposer arm 192 in the position shown, which is called the interposer rest position. In FIG. 31B, the solenoid 193 has been actuated by a voltage pulse which causes the interposer arm 192 to rotate clockwise about pin 195, moving the interposer finger 197 in the direction of arrow 198. Rotation of the interposer is stopped by projection 199 which is an integral part of the mounting plate 194. This state is called the interposer actuated position.

The interposer arm 192 is used to enable the movement of any of the movable retainers 154 by intercepting the path of any of the eight actuation arms 155. Referring to FIG. 29, the interposer 192 is shown in its rest position where it is unable engage the path of the arms 155.

Figure 32:
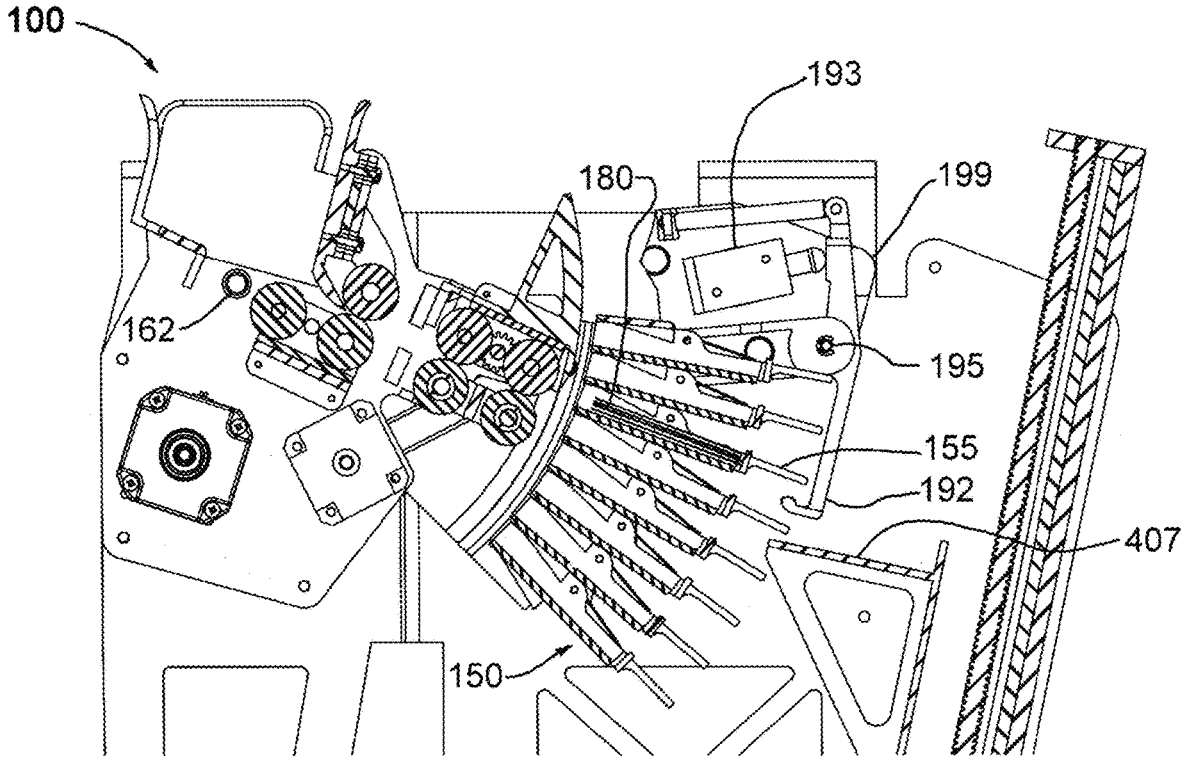
FIG. 32 is a side elevation view showing the preferred embodiment in its "pre-launch" state.

Referring to FIG. 32, the interposer is shown in the actuated position and the radial receiver 150 has been rotated about axle 162 to a "pre-launch" position prior to launching substack 180 onto elevator carriage 407. The elevator carriage 407 is shown in its loading position where it resides when moving substacks from all compartments 152. The radial receiver 150 has been momentarily stopped while the interposer finger 197 is injected into the path of the 3rd nest from the top and is in a position to intercept arm 155 of that nest when the radial receiver 150 next rotates clockwise. FIG. 32 thus illustrates the "pre-launch" state of the device 100 when it is about to move card substack 180 onto elevator carriage 407.

Figure 33:
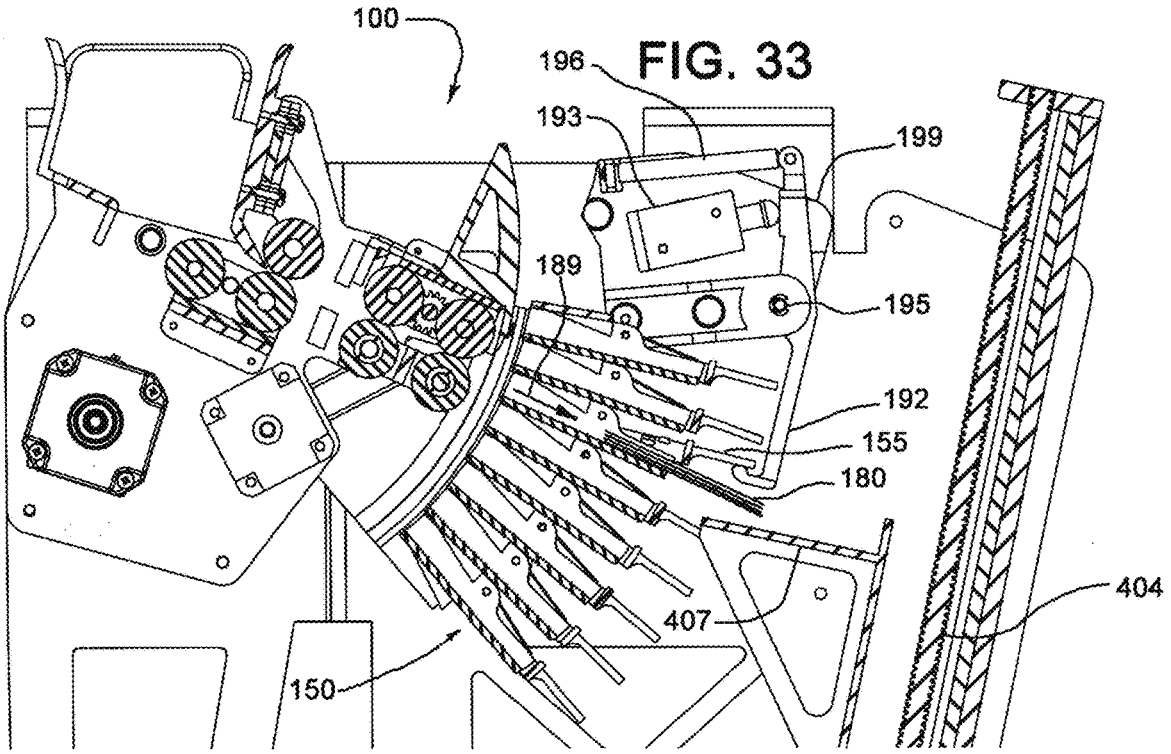
FIG. 33 is a side elevation section view showing a card substack being launched onto the elevator carriage.
Figure 34:
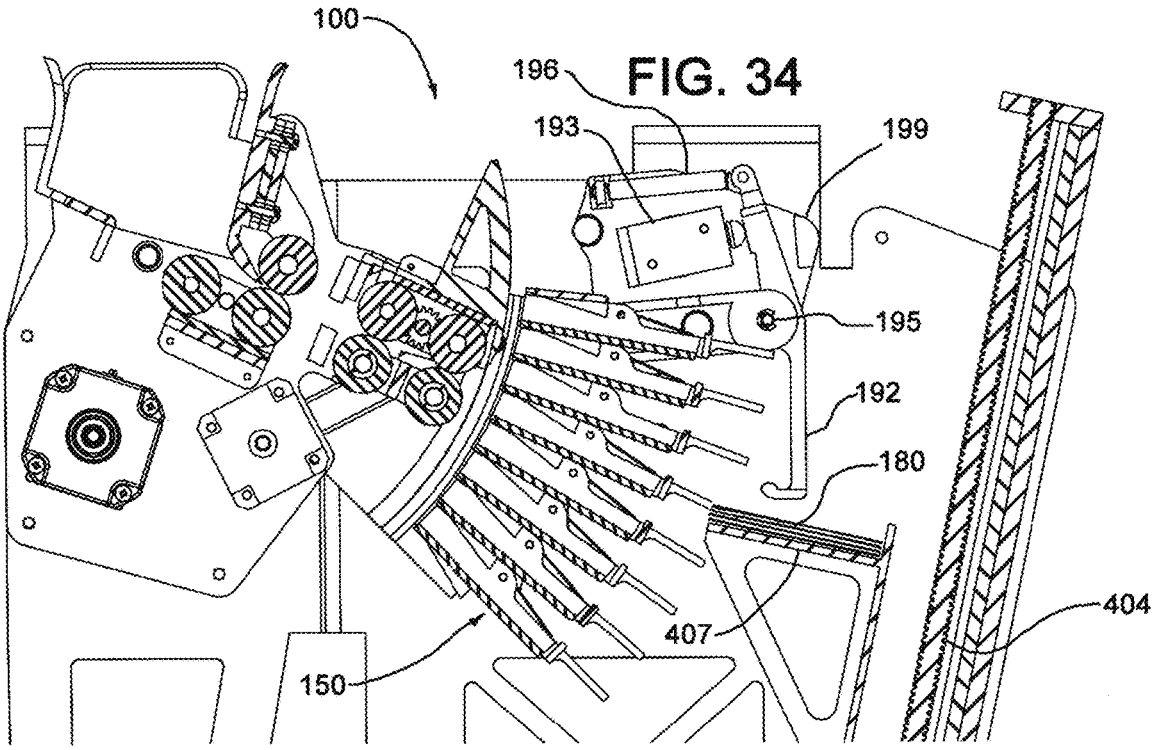
FIG. 34 is a side elevation section view showing a substack residing on the elevator carriage.

While interposer arm 192 is held in this actuated position (FIG. 32), the radial receiver 150 is thereafter rapidly rotated clockwise and rapidly stopped at the card delivery position as shown in FIG. 33. The deceleration causes centrifugal force to rapidly discharge the substack 180 into the elevator carriage 407 while the tab 155 of moveable retainer 154 is restrained. Arrow 189 in FIG. 33 indicates the direction of the centrifugal force upon the card stack 180 as the radial receiver 150 reaches its terminal clockwise destination. After a momentary pause, the radial receiver 150 is returned counterclockwise to the "pre-launch" position and the solenoid 193 is deenergized, allowing the interposer spring 196 to extract the interposer 192 from the path of actuator arms 155 as shown in FIG. 34. The device 100 is then ready to move the shuffled (randomized) substack 180 upward to the multi-card shoe by actuating the elevator assembly 440.

Once delivered to the elevator carriage 407, the device randomly positions another nest of the radial receiver 150 to the "pre-launch" position and actuates the interposer 192. Simultaneously, the elevator carriage 407 is elevated to deliver the substack 180 to the multi-card shoe. Upon return of the elevator carriage to its loading position, the centrifugal discharge cycle of the radial receiver 150 is repeated to move another substack to the elevator carriage 407.

In an alternate, but less advantageous embodiment, the radial receiver 150 may be rotated slowly to a state wherein the card substacks are moved to the elevator carriage 407 by gravity, rather than by centrifugal force. In this alternate embodiment, the card receiver rotates slowly to disgorge each nest substack after the interposer 192 has intercepted the moveable retainer 154. As the radial receiver 150 approaches the aligned position, the card substack thereafter slides onto the elevator carriage 407 solely by gravity.

Figure 1:
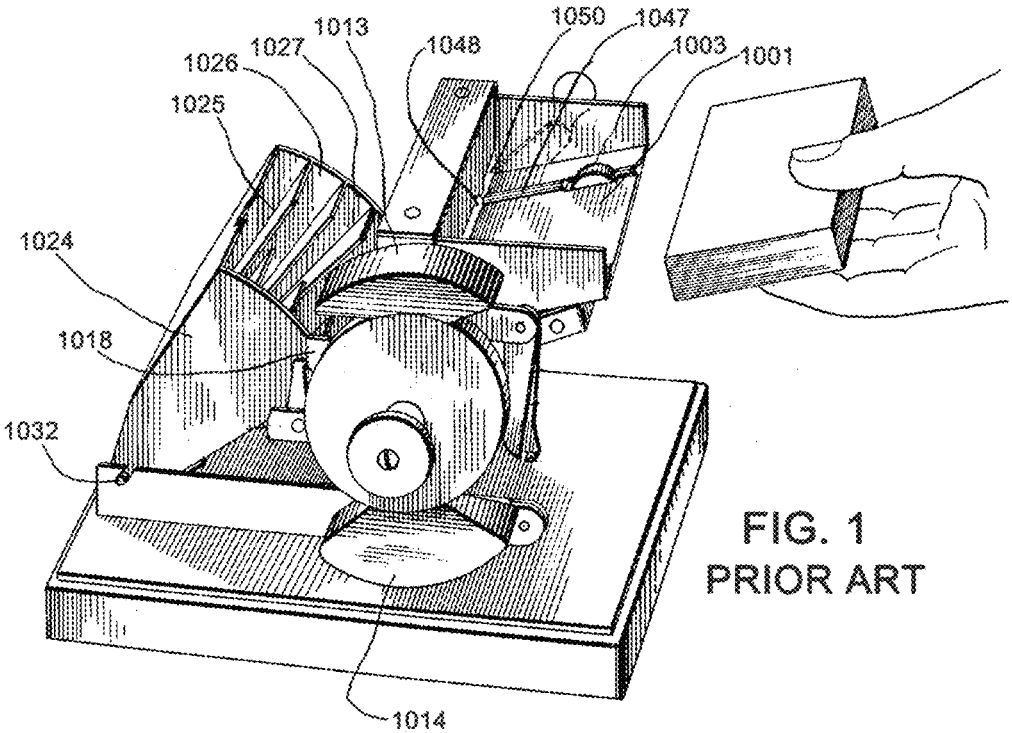
FIG. 1 PRIOR ART
FIG. 1 is a perspective view from an early (1932) hand-forming shuffler patent.
Figure 2:
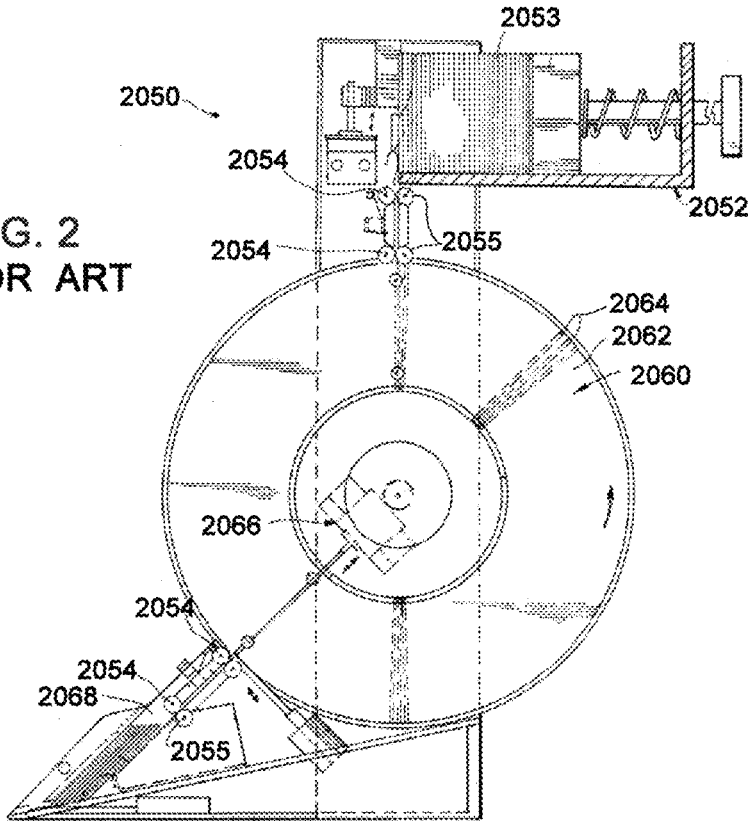
FIG. 2 PRIOR ART
FIG. 2 is a perspective view from a prior art (1986) carousel shuffler patent disclosure.
Figure 3A:
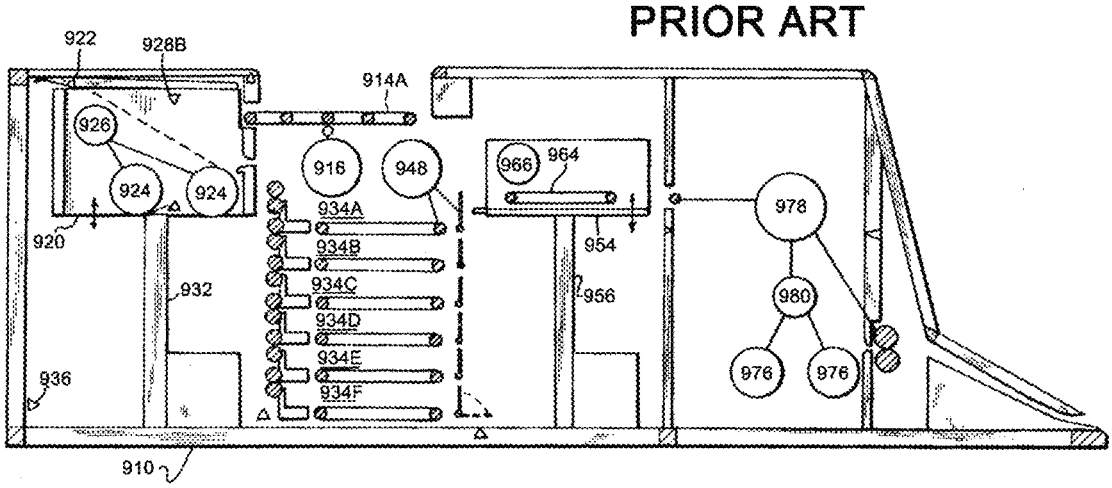
FIG. 3A PRIOR ART
FIG. 3A is a side elevation view from a prior art (1988) elevator shuffler patent disclosure.
Figure 3B:
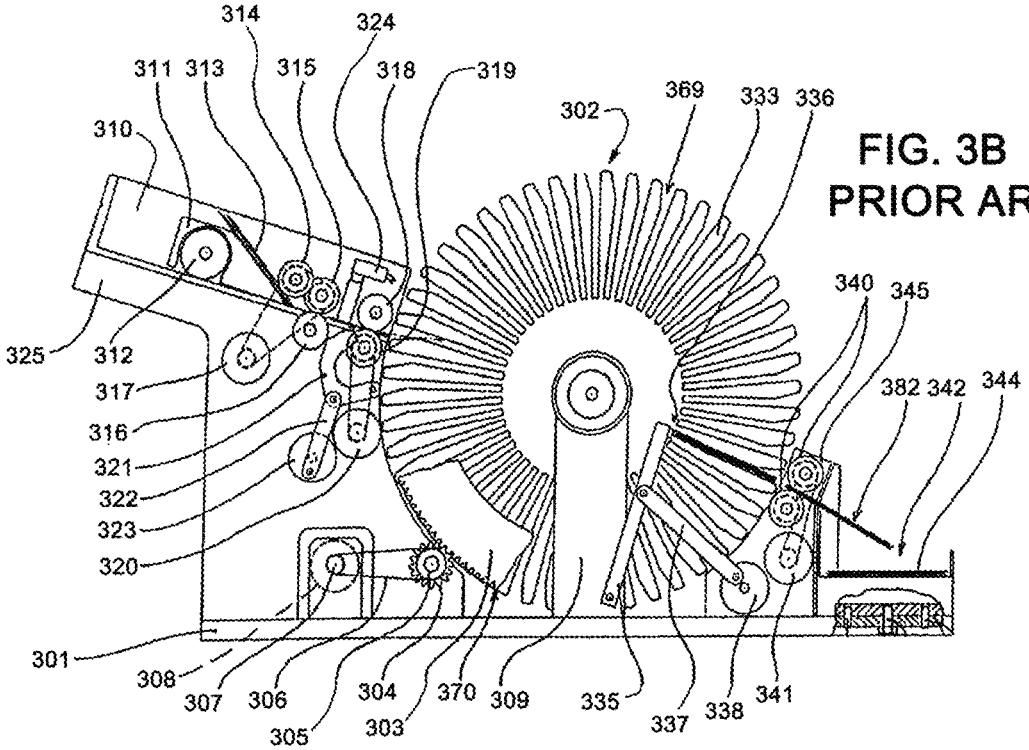
FIG. 3B PRIOR ART
FIG. 3B is a side elevation view from a prior art (2003) carousel shuffler patent disclosure.
Figure 4:
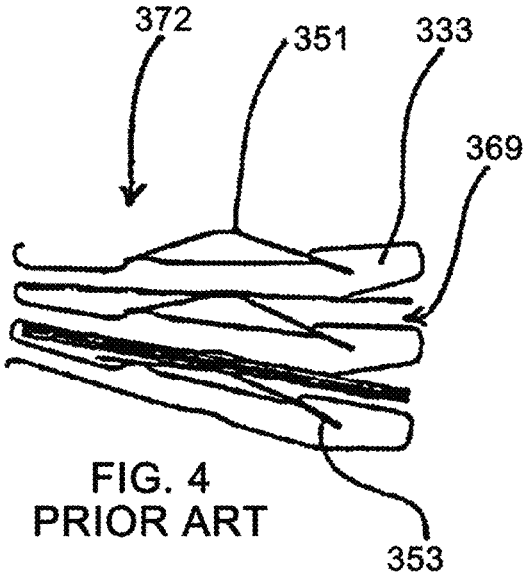
FIG. 4 PRIOR ART
FIG. 4 is a view of a clamping means from the prior art carousel shuffler patent disclosure in FIG. 3B.
Figure 5:
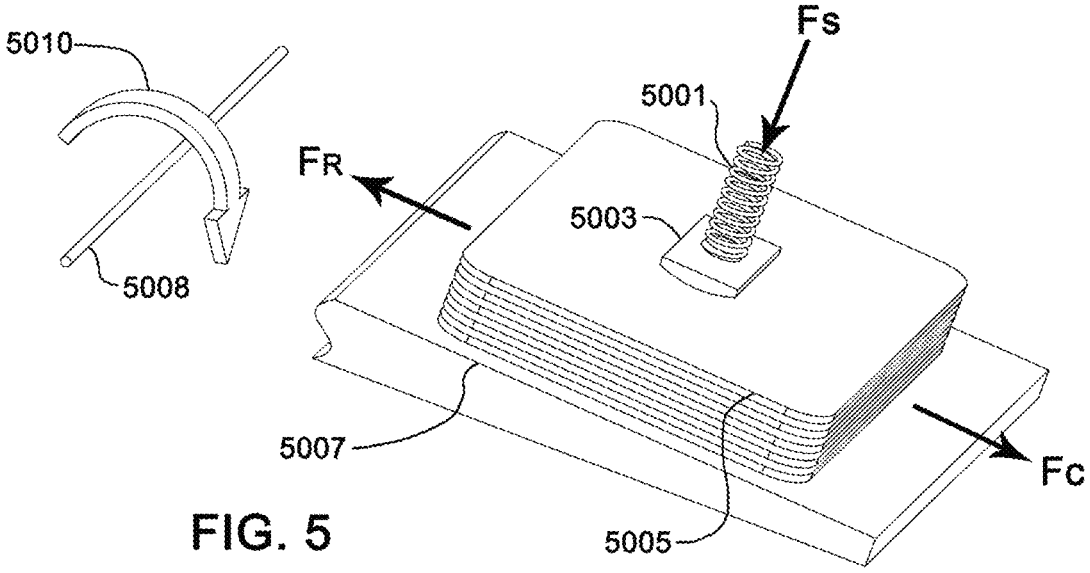
FIG. 5 is a diagram explaining the physics of the carousel clamping forces.
Figure 6:
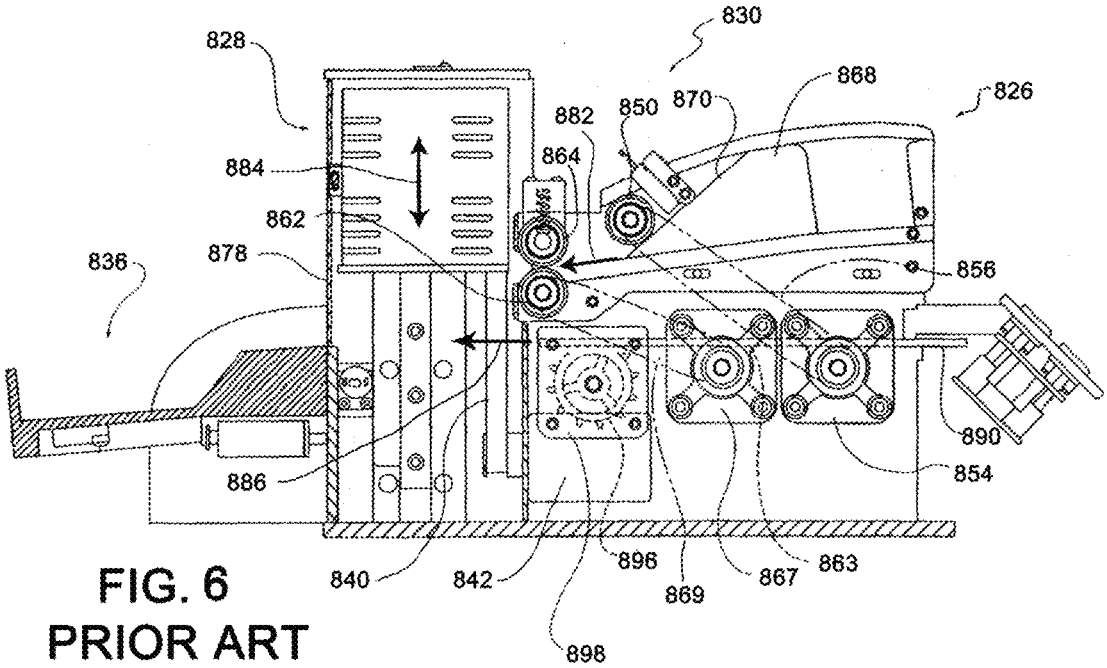
FIG. 6 PRIOR ART
FIG. 6 is a side elevation view from a prior art (2000) elevator shuffler patent disclosure.
Figure 7:
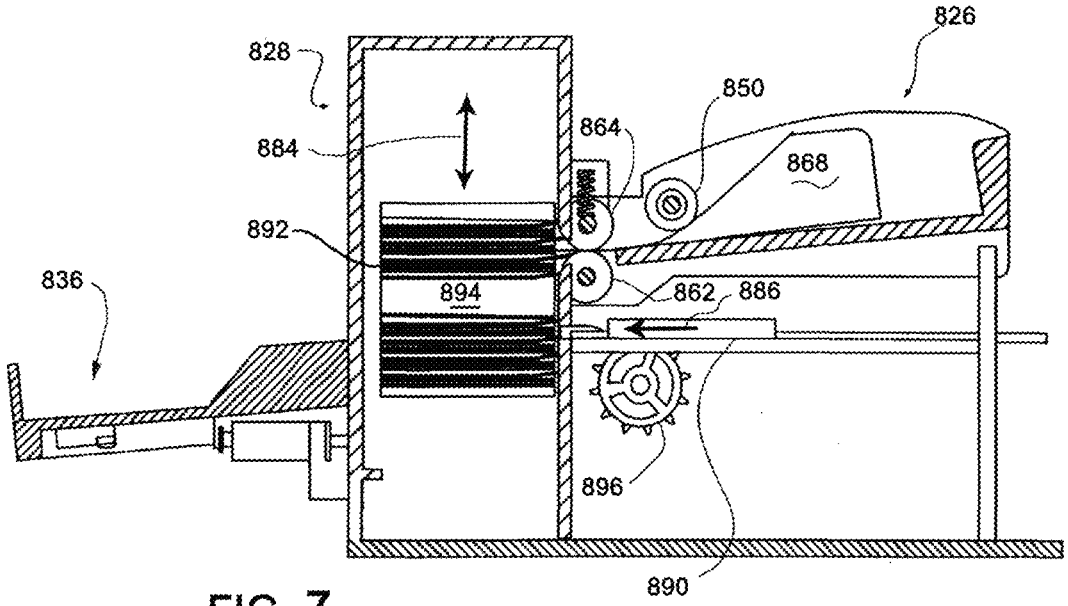
FIG. 7 PRIOR ART
FIG. 7 is another view from the prior art carousel shuffler patent disclosure in FIG. 6.
Figure 8:
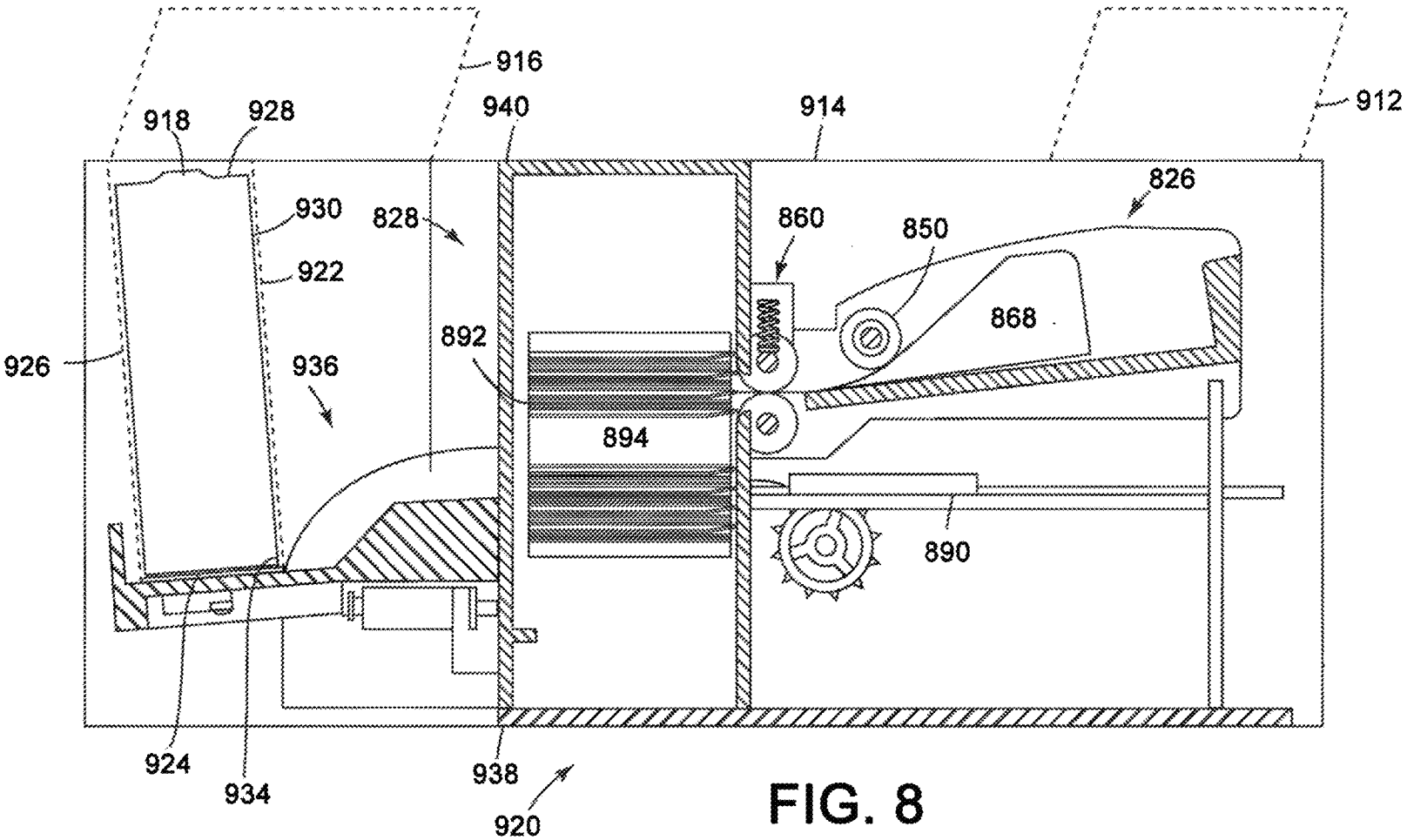
FIG. 8 PRIOR ART
FIG. 8 is a side elevation view from a prior art (2018) shuffler patent application which discloses embedding the shuffler of FIG. 6 into a flush-mounted table.
Figure 9:
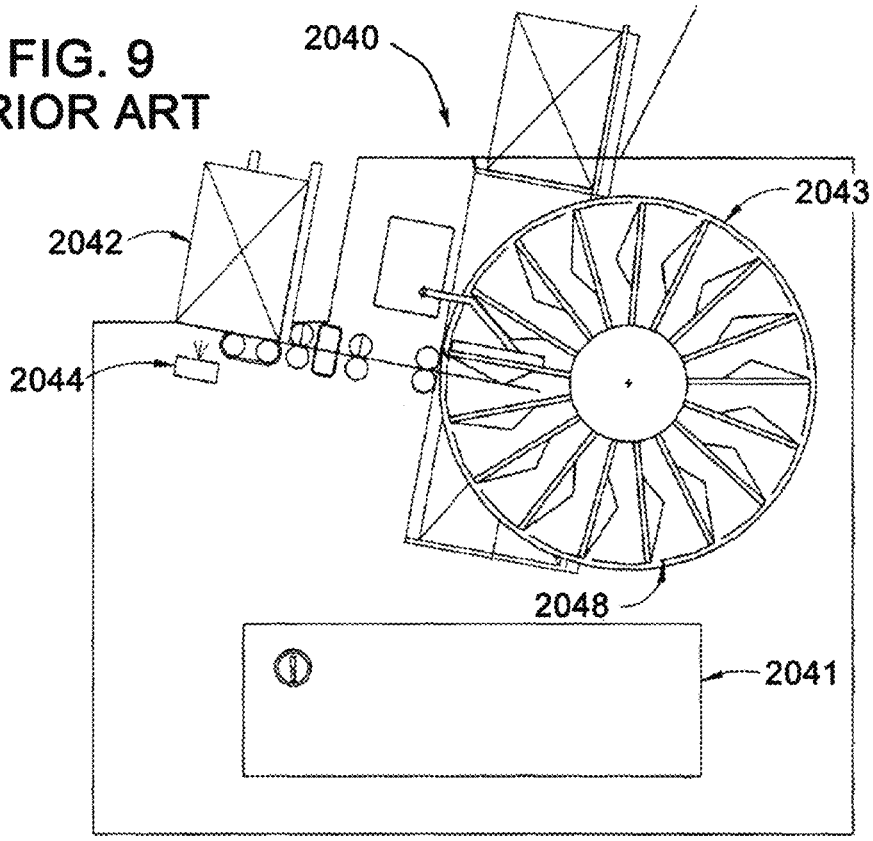
FIG. 9 PRIOR ART
FIG. 9 is a side elevation view from a prior art (1999) shuffler patent disclosure.
Figure 10:
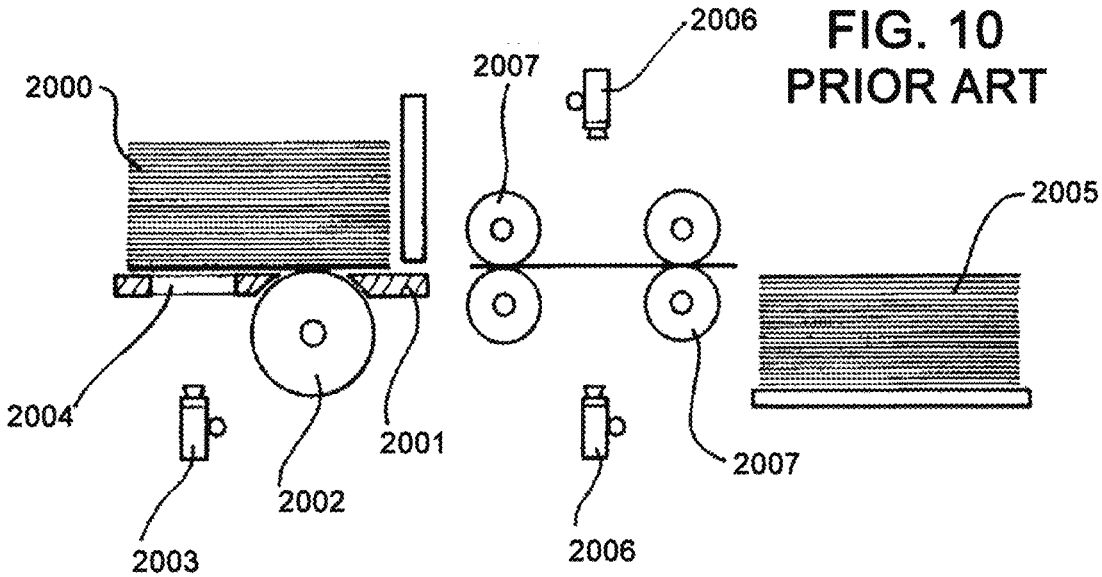
FIG. 10 PRIOR ART
FIG. 10 is a diagram from a prior art (2003) shuffler patent disclosure.
Figure 13:
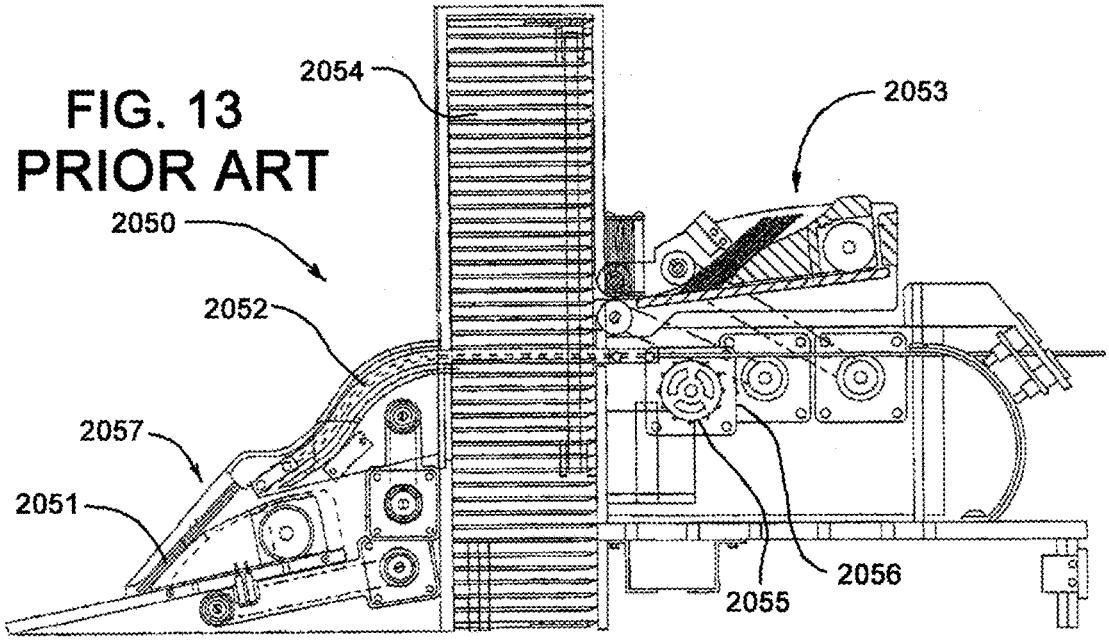
FIG. 13 PRIOR ART
FIG. 13 is a side elevation view of a prior art (2016) shuffling device.
Figure 14:
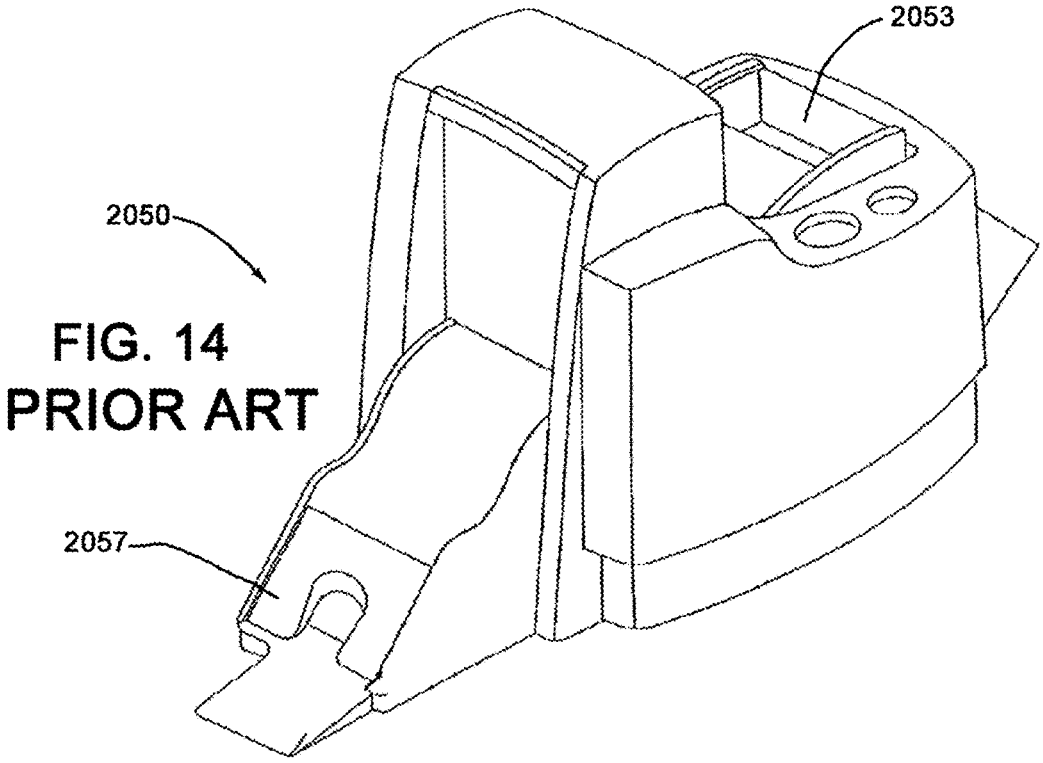
FIG. 14 PRIOR ART
FIG. 14 is a perspective view of the shuffling device shown in FIG. 13.
Figure 15:
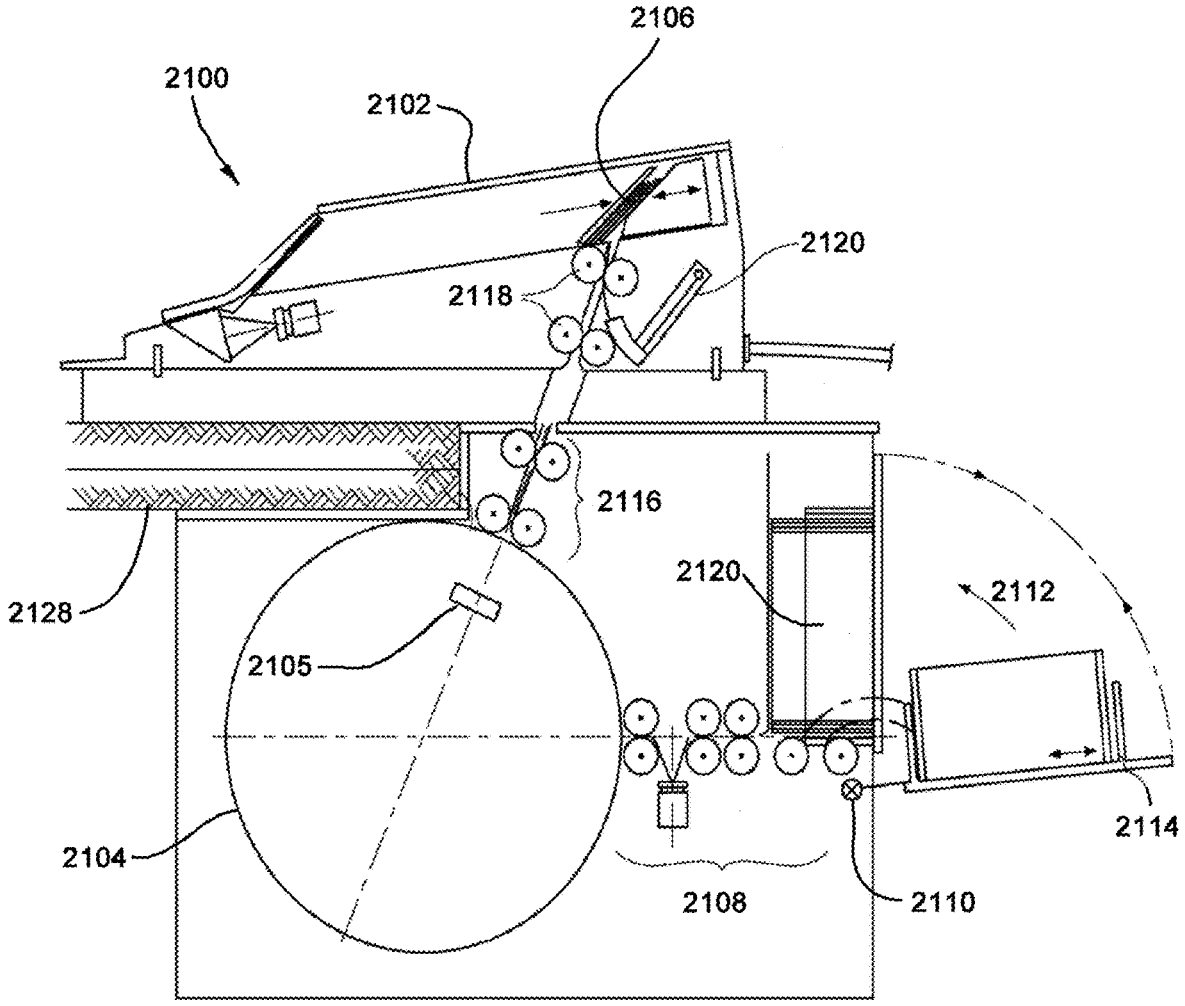
FIG. 15 PRIOR ART
FIG. 15 is a side elevation view of a prior art (2020) shuffling device.
Figure 16:
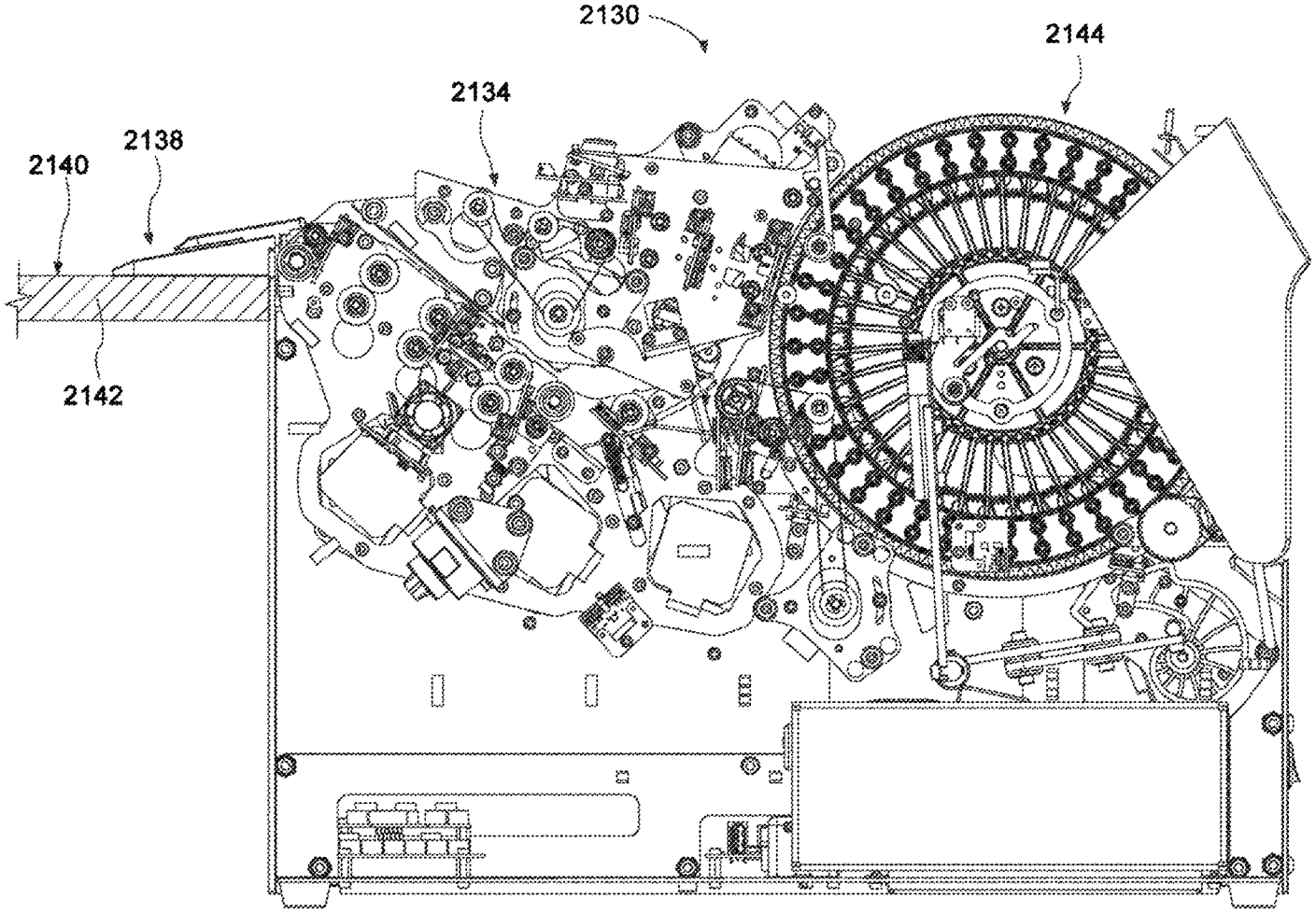
FIG. 16 PRIOR ART
FIG. 16 is a side elevation view of a prior art (2020) shuffling device.
Figure 35:
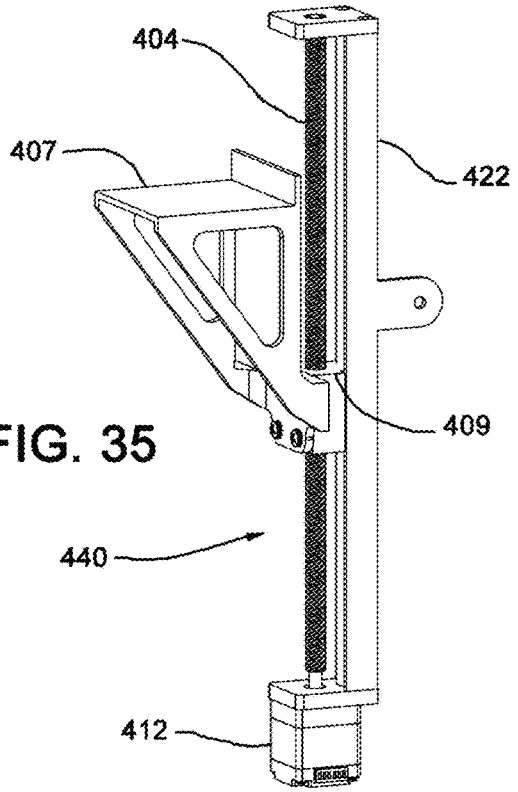
FIG. 35 is an isometric view of the elevator mechanism.
Figure 36:
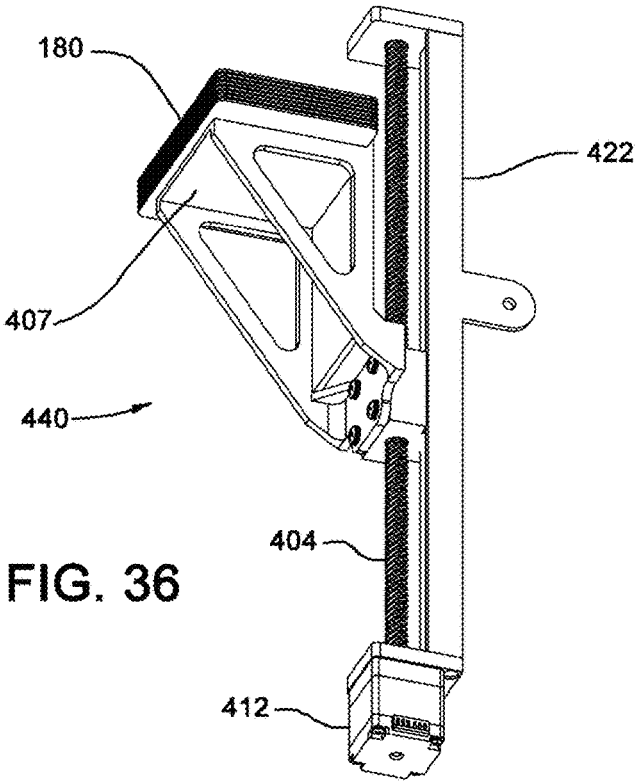
FIG. 36 is an isometric view showing a substack residing on the elevator carriage.

FIG. 35 shows the construction of the elevator assembly 440 in more detail. Elevator carriage 407 is an injection molded component that is suspended upon lead screw follower 409 which is moved along the axis of elevator frame 422 by lead screw 404. The carriage 407 consists of a simple platform and is referred to as a slot-less elevator. This term comes from the art wherein multi-slotted elevators are common, such as those shown in FIG. 6, FIG. 7 and FIG. 13. Step motor 412 is attached directly to the lead screw 404 and provides rotation to the lead screw. FIG. 36 illustrates a view of the lead screw assembly when supporting a substack 180. This view illustrates that the elevator carriage 407 supports the card stack in a central location, leaving lateral margins for the passage of a stripper mechanism which is explained below.

Figure 37:
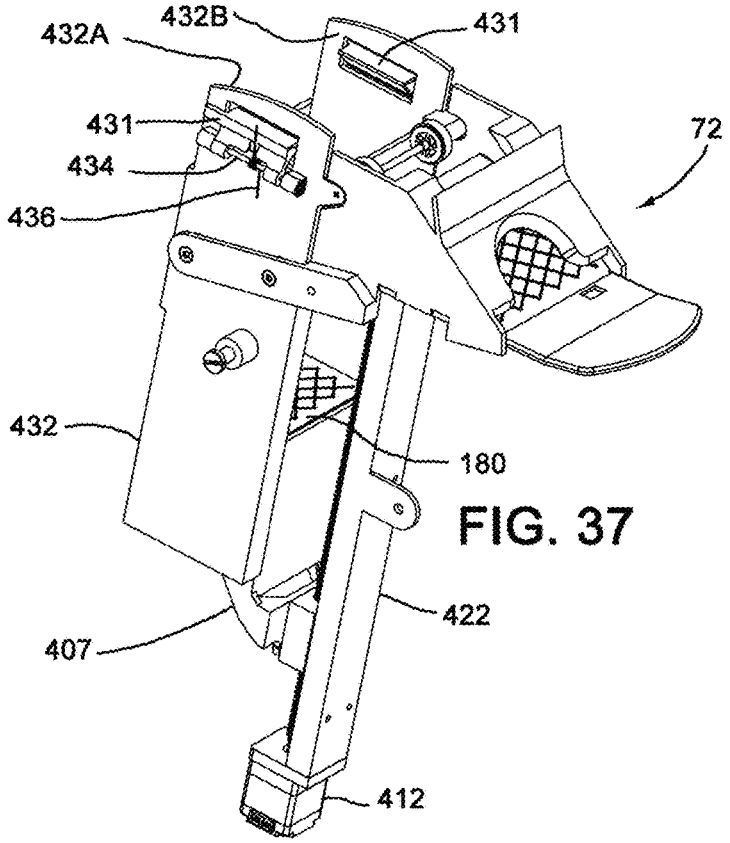
FIG. 37 is a perspective view of the elevator assembly and multi-card shoe.
Figure 38:
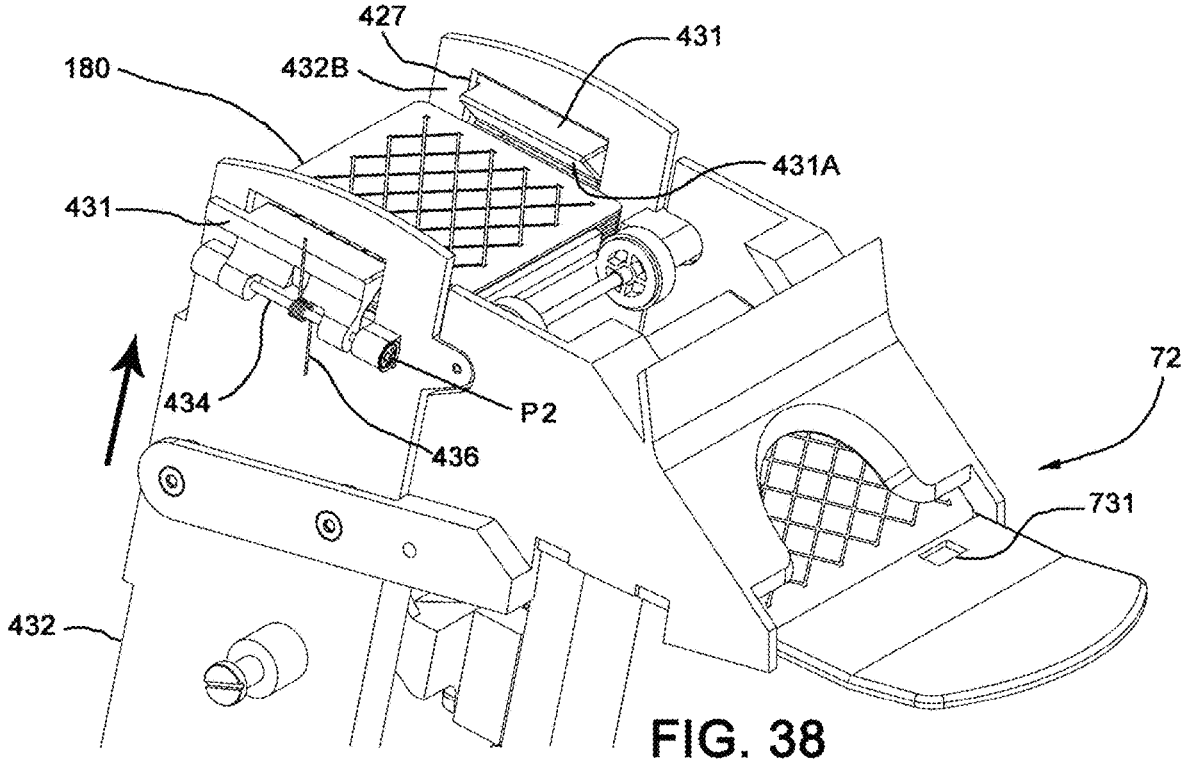
FIG. 38 is another view of the elevator housing as a card stack is about to make initial contact with the support pawls.

The elevator carriage 407 operates within an elevator housing 432 which is attached to the shoe 72 as shown in FIG. 37. Card substacks are laterally contained within the housing by walls 432A and 432B such that the substacks are loosely guided along their edges while keeping the substack laterally centralized upon the elevator carriage 407. After receiving a card substack 180, the elevator carriage 407 raises the substack to the upper region of the housing 432, where the substack 180 is transferred by a stripper mechanism to the shoe 72. The stripper mechanism comprises a pair of support pawls which are labeled as 431 in FIG. 37 and whose function is to strip the substacks 180 from the elevator carriage 407. Referring to FIG. 38, the support pawls 431 are rotatably mounted to the walls of the housing 432 and rotate upon pivot pins 434, which are held in a supporting position by torsion springs 436. A portion of each support pawl penetrates the elevator housing through windows 427 which are located within walls 432A and 432B.

Referring to FIG. 38, the two pivot pins 434 form axes P2 and P3 (P3 not shown), about which the support pawls 431 rotate. As the elevator carriage 407 raises the substack towards the upper opening of the housing 432, the substack 180 pushes against angular surfaces 431A on the underside of the support pawls 431, forcing them outward. The substack 180 is just about to collapse the support pawls 431 in the position shown in FIG. 38 where the elevator carriage 407 is moving substack 180 in the direction of the arrow.

Figure 39A:
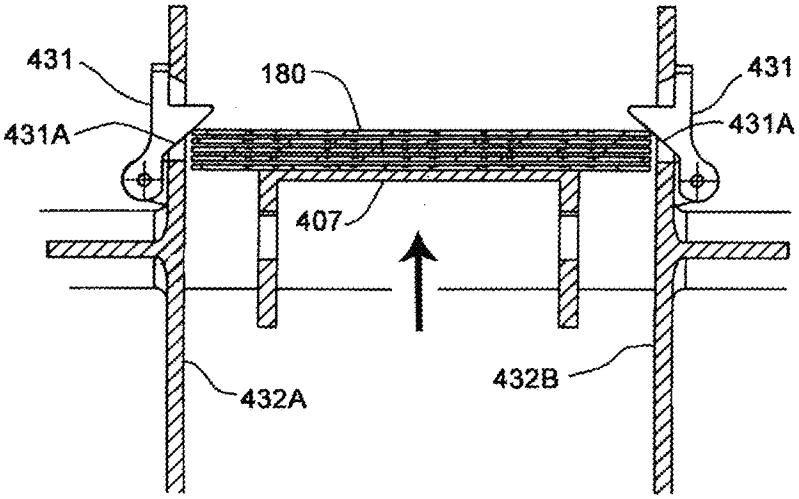
FIG. 39A through FIG. 39D illustrate the stripping mechanism motion sequence.
Figure 39B:
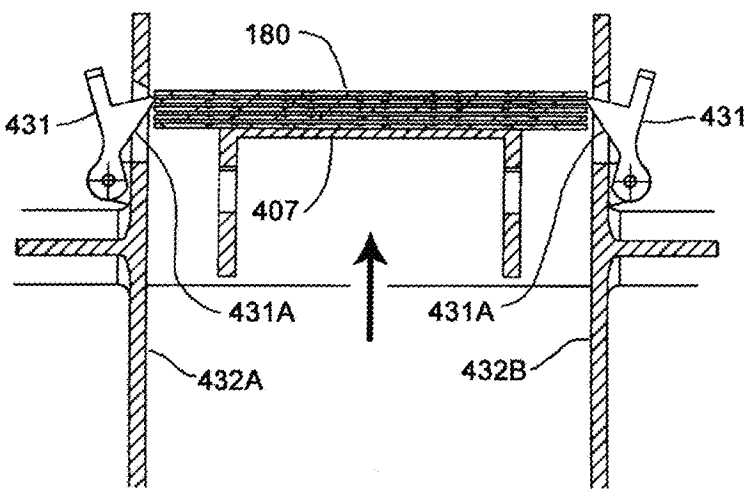
Figure 39C:
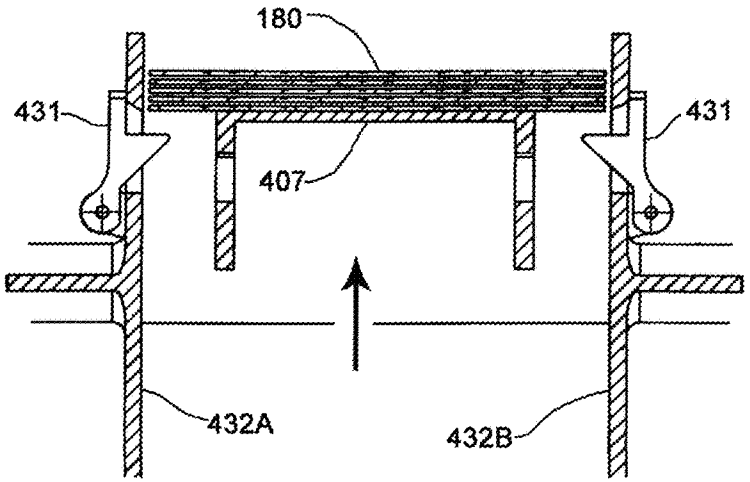
Figure 39D:
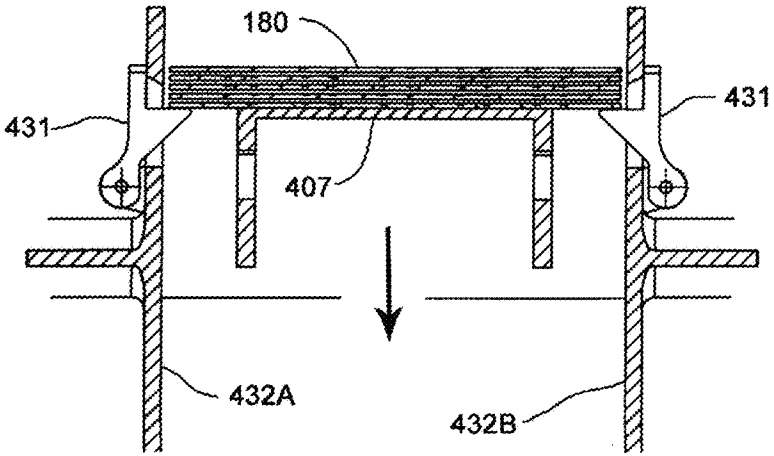

FIGS. 39A, 39B, 39C, and 39D illustrate side elevational section views which explain the sequence of collapsing the support pawls 431. This sequence is called the "stripper cycle" which consists of the steps utilized by the elevator mechanism 440 to temporarily transfer a substack to the support pawls 431. In FIG. 39A, a substack 180 is shown approaching the support pawls from below where the substack edges are making initial contact with the angular surfaces of the support pawls 431. Referring to FIG. 39B, as the elevator carriage 407 raises the substack, the support pawls 431 are pivoted outwardly away by contact between the angular surfaces 431A and the lateral surfaces of the substack 180. FIG. 39C shows that the substack is raised slightly above the support pawls 431, allowing them to snap back into position as urged by torsion springs 436 (see FIG. 38). In FIG. 39D, the elevator carriage 407 has transferred the substack to the support pawls 431, and the elevator carriage 407 continues moving downward. The elevator carriage 407 thus transfers the substack 180 to the support pawls 431 by a downward motion of the elevator.

Figure 40:
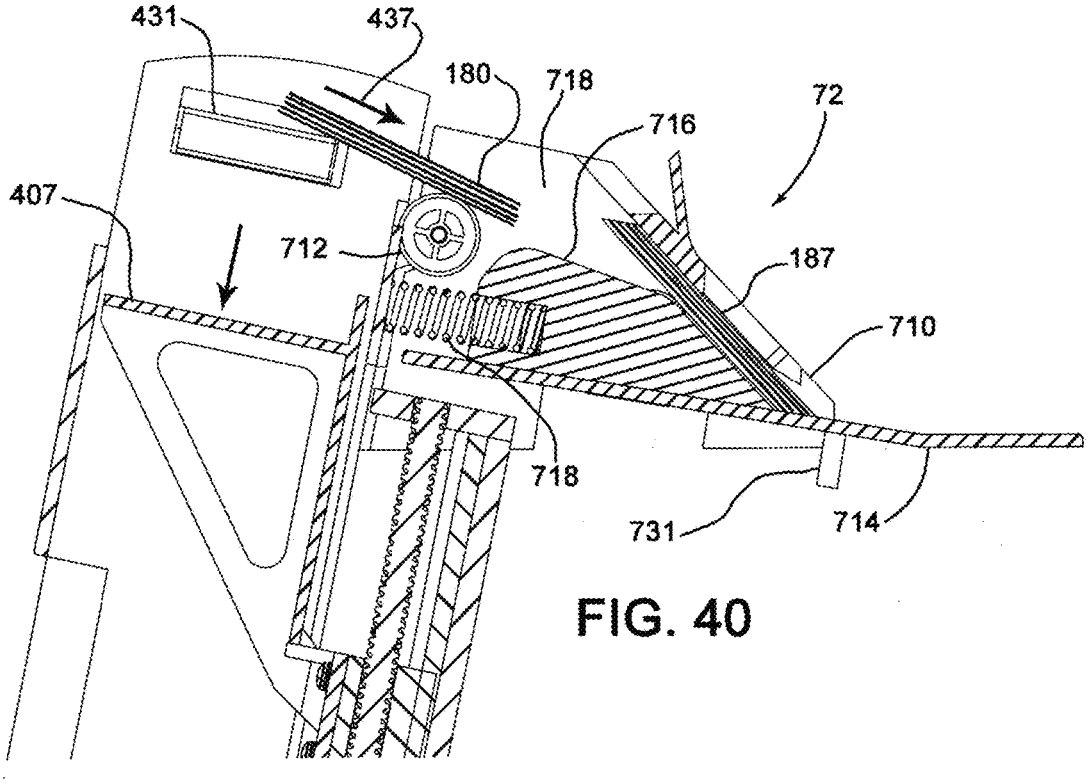
FIG. 40 is a section view which illustrates a card stack moving into the shoe cavity.

The substack 180 resides upon the support pawls 431 only momentarily as the elevator carriage 407 is retracted. FIG. 40 shows a cross section of the stripper mechanism and the shoe 72 whereupon substack 180 is moving into shoe cavity 718. The support pawls 431 are angularly mounted so as to allow the substack 180 to slide into the shoe cavity 718 as propelled by the downward inertia of the substack 180 as illustrated by the arrow 437 in FIG. 40. Shoe roll 712 acts as a guide that forms the substack trajectory. In this figure, a previously inserted substack 187 is shown seated within the shoe and forced against the inner surface of draw plate 710 by backer 716. Backer 716 is molded from a lubricious material so as to easily slide along the surface of discharge plate 714. Backer spring 718 biases the backer 716 towards the inner surface of draw plate 710, thus lightly clamping substack 187 against the draw plate 710.

After transferring the substack 180 to the shoe, the elevator carriage 407 is thereafter withdrawn to the loading position for reloading another substack. A first substack may reside within the shoe while a second substack is being moved onto the elevator carriage from the radial receiver 150, or while a second substack is being elevated to the support pawls 431.

Figure 41:
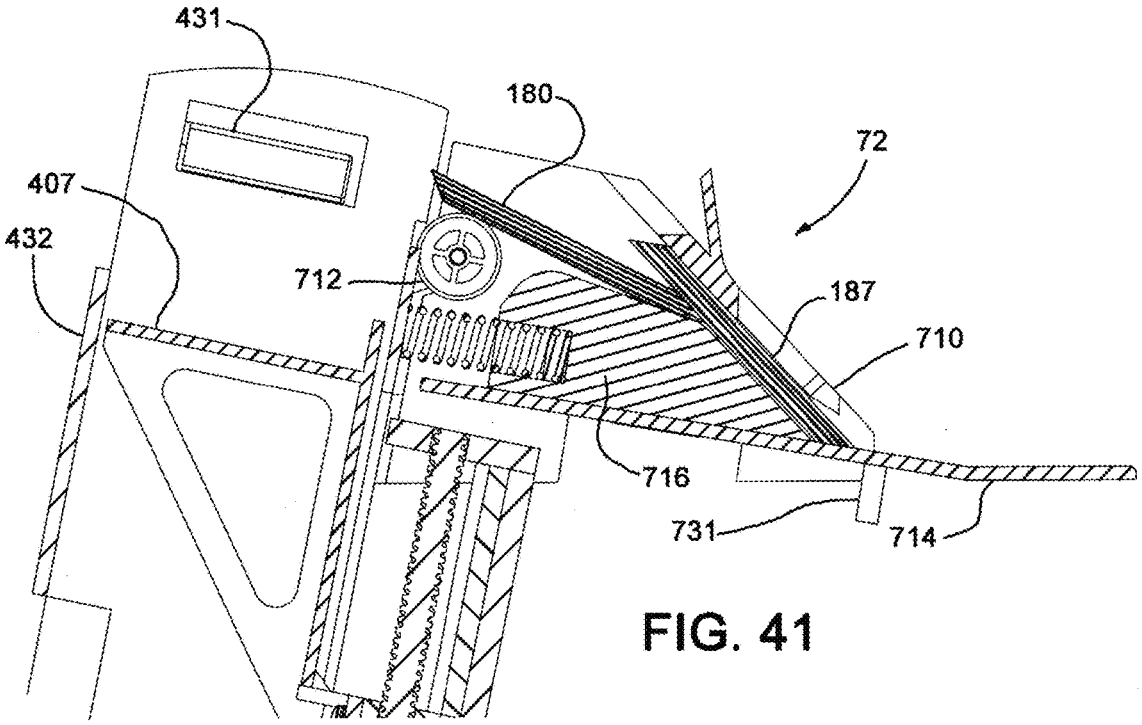
FIG. 41 is a section view which illustrates a card stack resting within the shoe cavity.

FIG. 41 is a section view of the shoe 72 and shows the configuration of the substack 180 as it rests upon shoe roll 712 after being moved into the shoe cavity by inertia. In this figure, a previously inserted substack 187 is shown seated within the shoe and the substack 180 is ready to be seated behind substack 187.

Figure 42A:
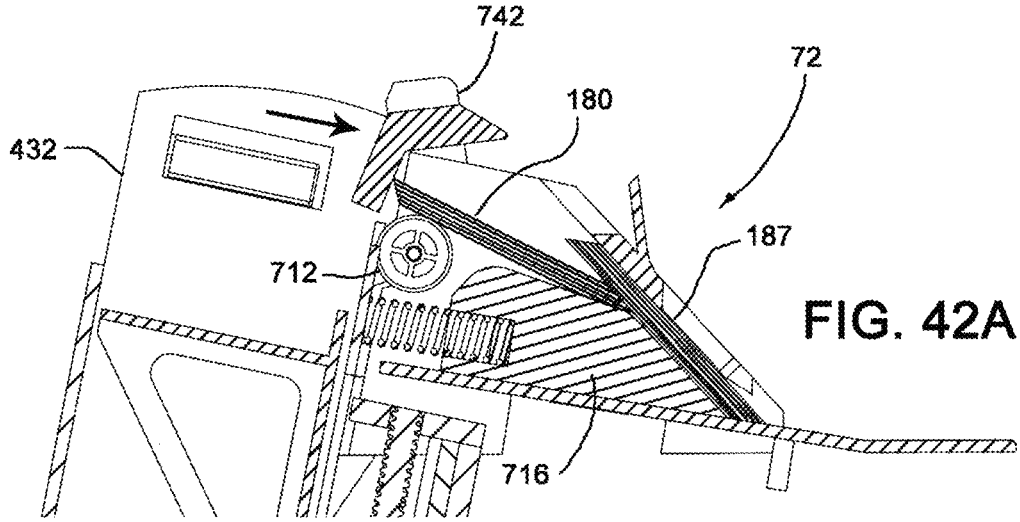
FIG. 42A is a section view which illustrates a substack making contact with the rotating yoke.
Figure 42B:
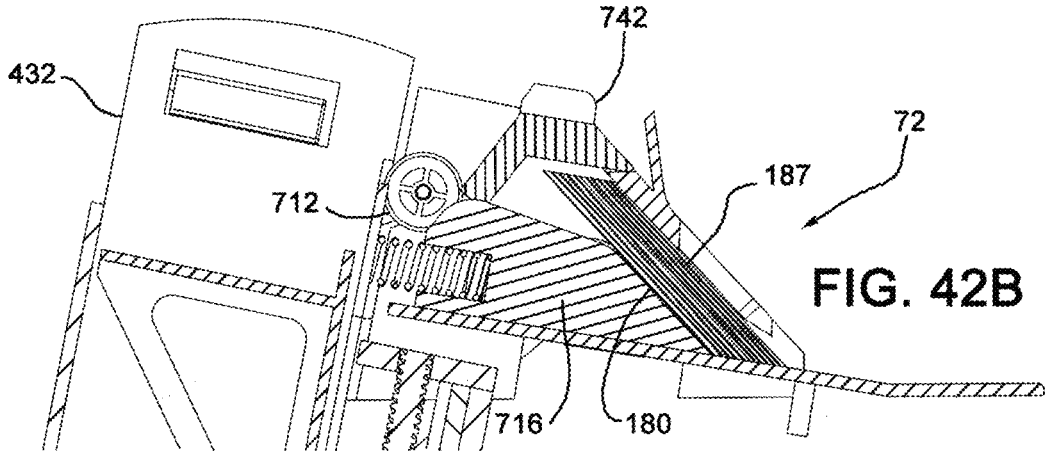
FIG. 42B is a section view which illustrates card stacks seated within the shoe.

A yoke 742 is utilized to seat substack 180 within the shoe by sweeping across the edge of the substack. FIG. 42A is a section view of the shoe 72 that illustrates the yoke making initial contact with the edge of substack 180 while FIG. 42B illustrates the terminal position of the yoke and the substack. It is noted that the geometry of the backer causes the substack 180 to snap into the ultimate position shown in FIG. 42B, such that the yoke need not seat the substack completely.

Figure 44B:
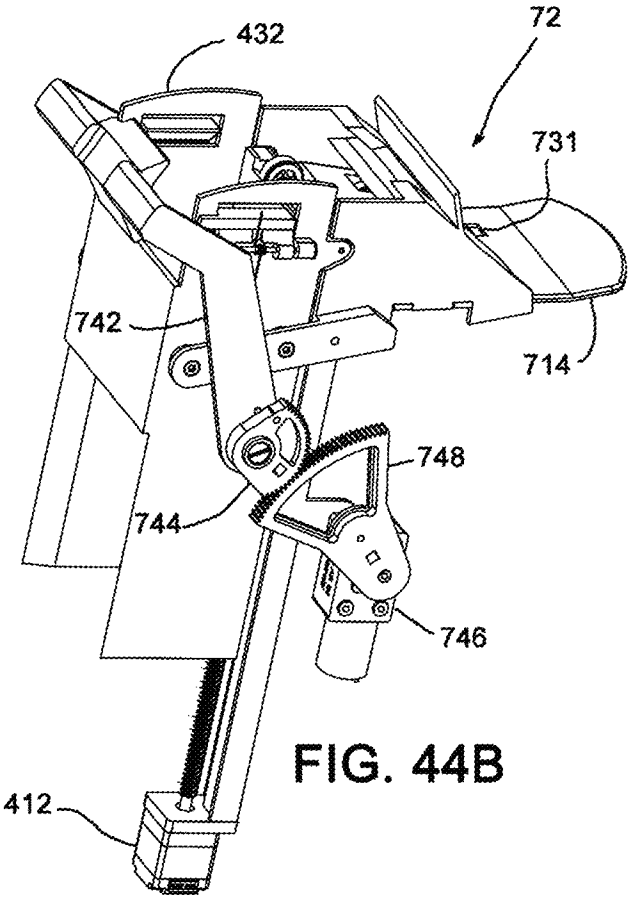
FIG. 44B is an isometric view of one embodiment which shows the rotating yoke and its motor driving mechanism in an actuated position.
Figure 44A:
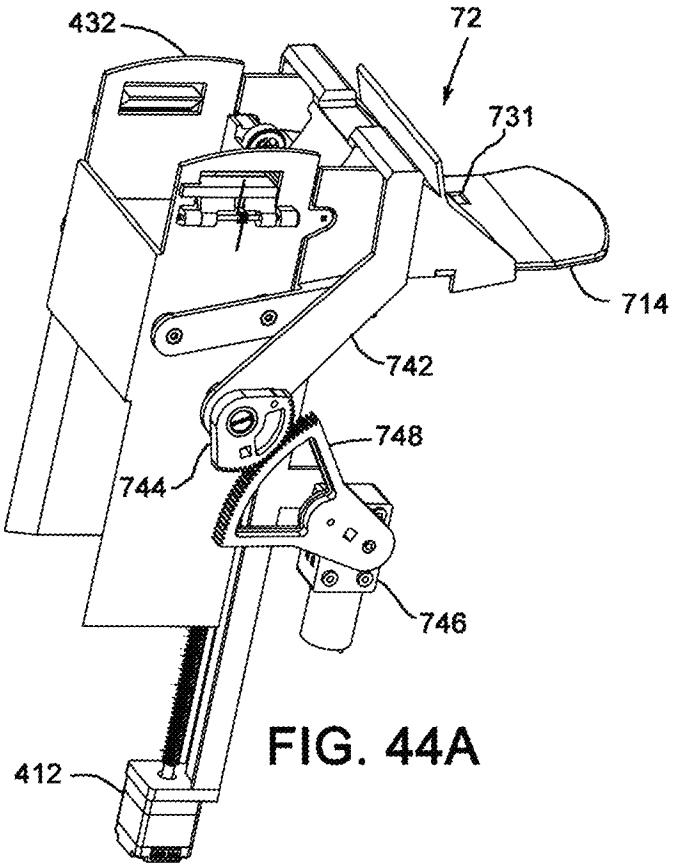
FIG. 44A is an isometric view of one embodiment which shows the rotating yoke and its motor driving mechanism in a rest position.

FIG. 44A and FIG. 44B are isometric views that illustrate the motion of the yoke 742 which in one embodiment is actuated by a DC motor gearbox 746. Yoke 742 rotates about the center of gear segment 744 and normally resides in a rest position as shown in FIG. 44A and FIG. 42B. During the time interval that elevator is raising a substack to the pawls 431, the DC motor 746 rotates the gear segments 744 and 748. The yoke 742 rotates CCW to the position shown in FIG. 44B. Once a substack has been released into the shoe as shown in FIG. 42A, the yoke 742 thereafter sweeps CW back to the rest position, partially seating the substack with the aid of the spring-loaded backer 716.

In a preferred embodiment, the DC motor 746 is eliminated and the yoke 742 is actuated by the motion of the elevator carriage via a cam. FIG. 45A illustrates the arrangement of a cam assembly consisting of a gear segment 761 and an injection molded cam 762 having a cam surface 767. Cam 762 and gear segment 761 are rigidly attached to each other and rotate synchronously on shaft 769. The assembly is biased by spring 763 and mounted upon bracket 765.

Figure 45B:
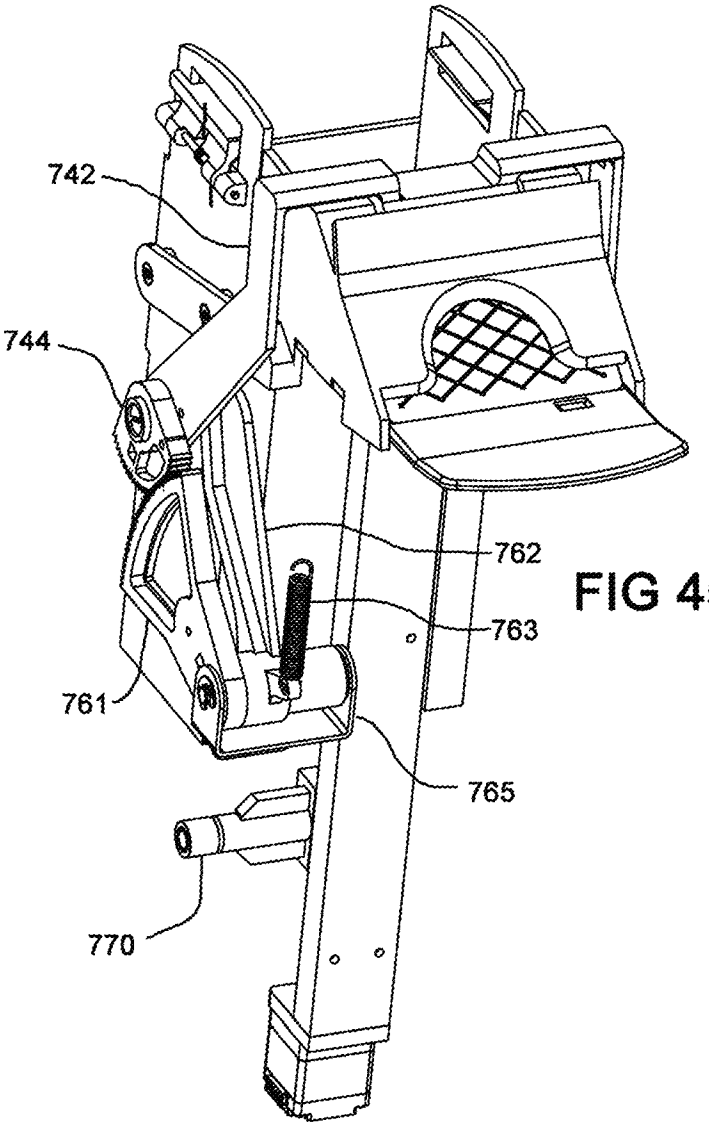
FIG. 45B is an isometric view of a preferred embodiment which shows the cam assembly of FIG. 45A attached to the elevator assembly.
Figure 45A:
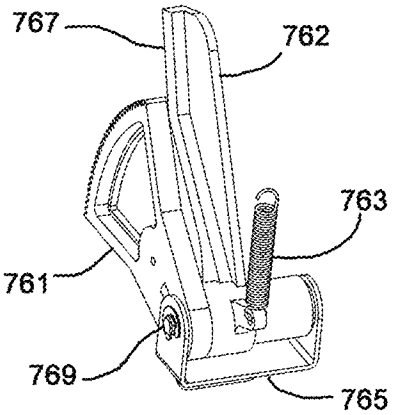
FIG. 45A is an isometric view of a preferred embodiment which shows a cam assembly used for actuating the yoke.

The cam assembly of FIG. 45A is shown attached to the elevator assembly in FIG. 45B. The lead screw follower 409 possess a ball bearing 770 which moves vertically in synchronization with the elevator movement. The ball bearing 770 is configured to contact the cam surface 767 as the elevator rises, thereby rotating the cam 762 and gear segment 761.

Figure 46B:
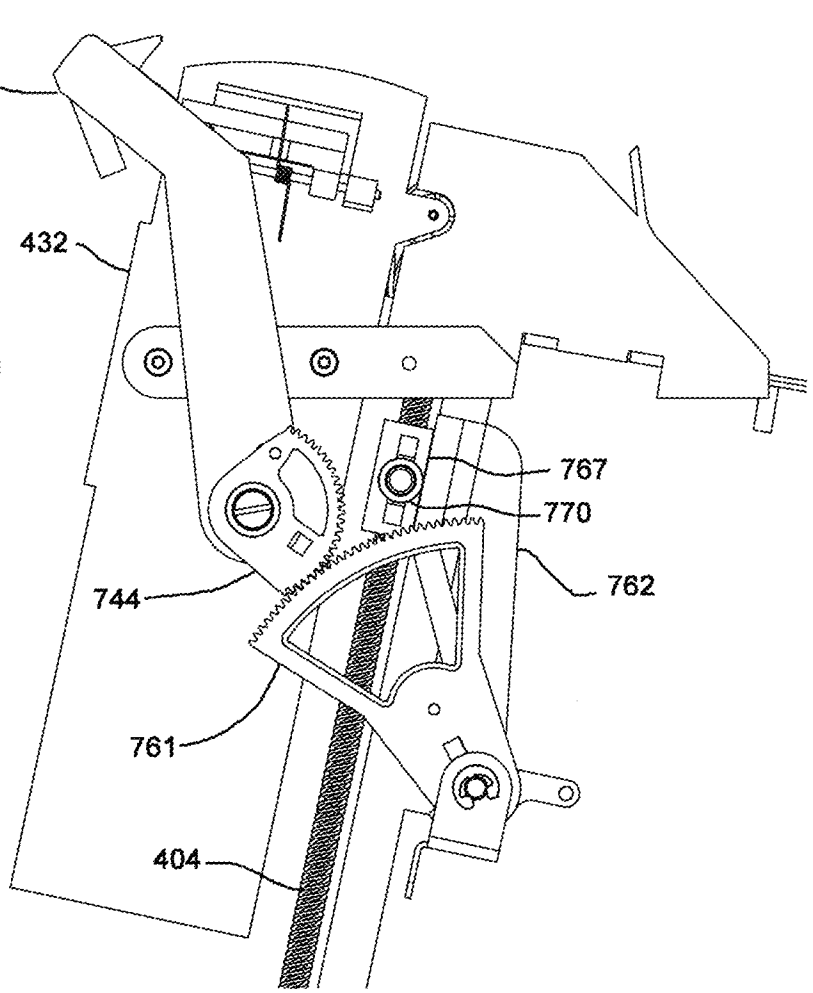
FIG. 46B is an isometric view of a preferred embodiment which shows the rotating yoke and its cam-driven mechanism in an actuated position.
Figure 46A:
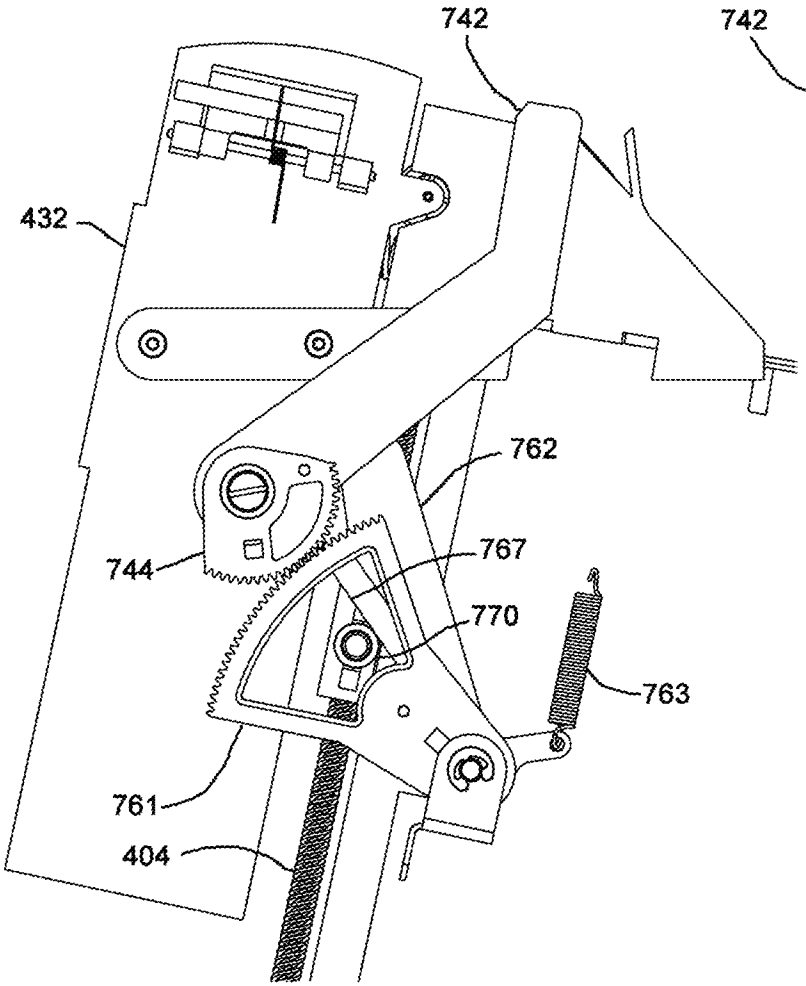
FIG. 46A is an isometric view of a preferred embodiment which shows the rotating yoke and its cam-driven mechanism in a rest position.

In FIG. 46A, the bearing 770 initially contacts the cam surface 767 of cam 762 as the elevator rises to move a substack into the shoe. As the bearing 770 continues upward, the cam movement rotates the gear segments 744 and 761 which rotate yoke 742 CCW to the position shown in FIG. 44B. The cam surface is designed to actuate the yoke 742 during a portion of the elevator movement and to thereafter hold that position during a second dwell condition. The return of the elevator to its lower position then returns the yoke 742 to the position shown in FIG. 44A by the force of spring 763.

The preferred embodiment can therefore be executed with four motors. A first motor strips the cards from the bottom of the stack in input portal 90 and a second motor accelerates each card into a compartment of radial receiver 150 as shown in FIG. 24. A third motor rotates the radial receiver 150 and a fourth motor operates the elevator and the yoke.

The microcontroller keeps a continuous count of the number of cards within each compartment, within the elevator and within the shoe. A sensor 731 is utilized to detect each card as it is removed from the shoe by a dealer as shown in FIG. 38 and FIG. 41. The microcontroller thereby keeps a count of the number of cards within the shoe at any given moment in time. In one embodiment, the elevator will move from its queued position (FIG. 43) to move a new substack 181 into the shoe when the card count within the shoe is reduced to 10 cards. The number of cards residing in the shoe during continuous operation will be automatically maintained within the range from 10 to 29 cards.

Figure 43:
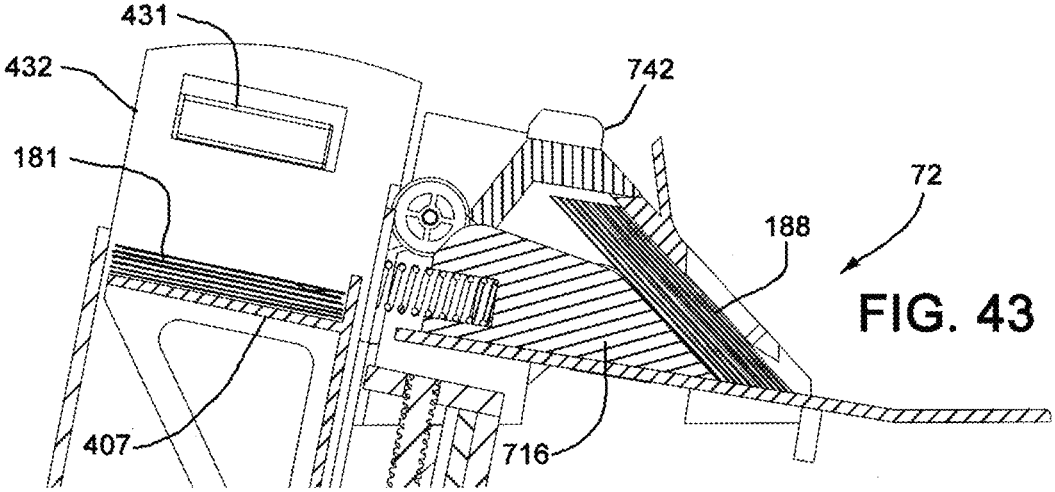
FIG. 43 is a section view which illustrates a card stack queued upon the elevator awaiting insertion into the shoe.

The card handing device claimed herein can operate in a "continuous" mode utilizing from one to four decks. The device may be prepared by randomizing (shuffling) the entirety of the four decks before commencing a game or series of rounds of a game. The threshold value in one embodiment allows a substack of 19 cards to occupy a compartment before it is emptied. The shoe has a maximum capacity of two substacks (38 cards). In addition, one substack of 19 cards can be queued on the elevator carriage. FIG. 43 illustrates that condition where one substack (19 cards) is queued upon the elevator and two substacks comprising 38 cards (188) are illustrated residing in the shoe 72. Eight additional substacks of 19 cards each may also be residing in the eight radial compartments, thus allowing a total of 209 randomized cards to be queued within the device. The entirety of the four decks may be inspected, randomized and queued prior to commencing play with the device.

Dealing cards from a shoe is one of the oldest forms of randomization. Normally a dealer will issue one card to each player in rotating fashion. If there are seven players, then each player will receive every 7th card from the plurality of cards that reside in the shoe. The conclusion is that dealing from a shoe provides significant additional randomization over and above the randomizing mechanism that is the source of providing cards to the shoe.

As explained above, the commercial success of the ACER hand forming shuffler established the fact that eight (8) compartments provide sufficient randomness to deliver play-ready substacks (hands) to an exit portal based upon commercial practice. If that device were delivering hands of seven cards and the dealer decided to distribute those cards individually to seven players, one at a time, then that original substack would be further randomized significantly. For this reason, a compartment shuffler having 8 compartments and delivering substacks to a multi-card shoe provides more than sufficient randomization.

One of ordinary skill, having designer's choice, may choose to utilize different forms of actuators and transport components than those described herein. Other forms of transport components, including cables, gears, chains and other types of belts may be substituted for those described herein. Other types of motors and solenoids are also logical substitutions and other types of sensors may be implemented as is well known in the art. The device may be configured to utilize more or less radially-arranged nests and each nest may be configured to hold more or less cards. Additionally, the capacity of each nest may be altered such that some nests hold a different number of cards without deviating from the invention. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handing device for shuffling playing cards in a casino comprising:

a bezel having a mounting surface;

a control panel positioned on the exterior of the bezel;

an unshuffled card input portal consisting of a receiving cavity;

a shuffled card discharge portal consisting of a multi-card delivery shoe for receiving substacks of play-ready cards from an elevation below a multi-card storage cavity of the shoe;

the shoe interfaced to a stripper mechanism which comprises a pair of support pawls;

a rotatable card receiver having a plurality of radially-arranged card storage nests which rotate about a common axis;

each nest having an exit orifice and an entrance orifice;

each nest holding a plurality of cards;

at least one microcontroller responsive to the control panel;

a motor that rotates the card receiver incrementally and bidirectionally amongst the radially-arranged nests while producing centrifugal force;

a card transport that moves cards from the input portal to the rotatable card receiver in the direction of the centrifugal force;

at least one retainer that retains cards within the rotatable card receiver in opposition to centrifugal force;

card substacks within each nest being aligned by the retainer; and wherein the card handing device moves cards into the nests and out of the nests in the same centrifugal force direction; and wherein the substacks from each nest are individually moved from an elevation below the shoe to an elevation above the shoe during delivery to the shoe.

2. The card handling device of claim 1 wherein the multi-card delivery shoe resides at an elevation above the bezel mounting surface.

3. The card handling device of claim 1 wherein the device may operate in a continuous mode.

4. The card handling device of claim 1 wherein the rotatable card receiver resides at an elevation below the bezel mounting surface.

5. The card handling device of claim 4 having a slot-less elevator that elevates card substacks for delivery to the card delivery shoe.

6. The card handling device of claim 5 wherein card substacks are moved from the nests to the elevator by centrifugal force.

7. The card handling device of claim 5 wherein card substacks are moved from the nests to the elevator solely by gravity.

8. The card handling device of claim 1 wherein the entrance orifice of each nest is larger in size than the exit orifice of each nest.

9. The card handling device of claim 5 wherein card substacks are removed from the slot-less elevator by a downward motion of the elevator.

10. The card handling device of claim 5 wherein card substacks are removed from the elevator by the stripper mechanism which resides at an interface with the multi-card shoe.

11. The card handling device of claim 10, wherein the stripper mechanism is actuated by movement of the slot-less elevator.

12. The card handling device of claim 10, wherein card substacks are moved from the stripper mechanism to the shoe cavity by inertia.

13. The card handling device of claim 5, wherein card substacks are moved to a seated position within the shoe by a rotating yoke.

14. The card handling device of claim 13, wherein the rotating yoke is actuated by a dedicated motor.

15. The card handling device of claim 13, wherein the rotating yoke is actuated by the elevator motion.

16. The card handling device of claim 5 wherein a first substack and a second substack may simultaneously reside within the card delivery shoe while a third substack resides upon the slot-less elevator.

17. The card handing device of claim 1 whereupon four decks may be inspected, randomized and queued within the device prior to initiating a card game.

18. The card handing device of claim 1 whereupon the control panel resides between the input portal and the discharge portal.

* * * * *